US010851542B2

(12) United States Patent
Hensley et al.

(10) Patent No.: US 10,851,542 B2
(45) **Date of Patent: *Dec. 1, 2020**

(54) FIRE AND WATER RESISTANT, INTEGRATED WALL AND ROOF EXPANSION JOINT SEAL SYSTEM

(71) Applicant: EMSEAL JOINT SYSTEMS LTD., Westborough, MA (US)

(72) Inventors: Lester Hensley, Westborough, MA (US); Walter Jones, Northborough, MA (US); Bill Witherspoon, Guelph (CA)

(73) Assignee: EMSEAL JOINT SYSTEMS LTD., Westborough, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/681,622

(22) Filed: Aug. 21, 2017

(65) Prior Publication Data

US 2017/0342708 A1 Nov. 30, 2017

Related U.S. Application Data

(63) Continuation-in-part of application No. 15/613,936, filed on Jun. 5, 2017, and a continuation-in-part of (Continued)

(51) Int. Cl.
*E04B 1/98* (2006.01)
*E04B 1/68* (2006.01)
(Continued)

(52) U.S. Cl.
CPC ..... *E04B 1/948* (2013.01); *E04B 1/68* (2013.01); *E04B 1/6806* (2013.01);
(Continued)

(58) Field of Classification Search
CPC ..... E04B 1/6812; E04B 1/68; E04B 1/948; E04B 1/98; E04B 1/66; E04B 1/944;
(Continued)

(56) References Cited

U.S. PATENT DOCUMENTS 517,701 A 4/1894 Knower
945,914 A 4/1909 Colwell
(Continued)

FOREIGN PATENT DOCUMENTS

CA 1280007 4/1989
CA 1334268 8/1989
(Continued)

OTHER PUBLICATIONS

Schul International Co., LLC., Firejoint 2FR-H, Fire Rated Expansion Joint 2 Hour Fire Rated, labeled Copyright 2012, pp. 1-2.
(Continued)

*Primary Examiner* — Phi D A
(74) *Attorney, Agent, or Firm* — MKG, LLC

(57) ABSTRACT

A fire and water resistant, integrated wall and roof expansion joint seal system includes an expansion joint seal for a structure. The seal includes a central portion having an underside and at least one central chamber disposed around a centerline, a first flange portion extending outwardly from the centerline and a second flange portion extending outwardly from the centerline in a direction opposite the first flange portion. The system further includes a joint closure. The joint closure includes a core and a layer of a water resistant material disposed on the core. The joint closure further includes an end portion configured to match and integrate with the underside of the central portion to form the watertight, integrated wall and roof expansion joint seal system. A fire retardant material is included in the core in an amount effective to pass testing mandated by UL 2079, and the core with the fire retardant material therein is configured to facilitate compression of the core when installed between the first substrate and the second substrate by repeatedly expanding and contracting to accommodate movement of the first substrate and the second substrate; and the core with
(Continued)

the fire retardant material included therein is configured to pass the testing mandated by UL 2079. Movement of one or both of the first substrate and the second substrate causes a response in the central portion to maintain the seal.

32 Claims, 21 Drawing Sheets

Related U.S. Application Data application No. 14/211,694, filed on Mar. 14, 2014, now Pat. No. 9,739,050, said application No. 15/613,936 is a continuation of application No. 13/729,500, filed on Dec. 28, 2012, now Pat. No. 9,670,666, said application No. 14/211,694 is a continuation-in-part of application No. 13/652,021, filed on Oct. 15, 2012, now Pat. No. 9,322,163, said application No. 13/729,500 is a continuation-in-part of application No. 12/622,574, filed on Nov. 20, 2009, now Pat. No. 8,365,495.

(60) Provisional application No. 61/788,866, filed on Mar. 15, 2013, provisional application No. 61/547,476, filed on Oct. 14, 2011, provisional application No. 61/116,453, filed on Nov. 20, 2008.

(51) Int. Cl.

| | |
|---|---|
| ***E04B 1/94*** | (2006.01) |
| ***E04C 2/20*** | (2006.01) |
| ***E04D 13/14*** | (2006.01) |
| ***E04D 13/15*** | (2006.01) |

(52) U.S. Cl.
CPC ..... *E04B 1/6812* (2013.01); *E04B 1/6813* (2013.01); *E04B 1/944* (2013.01); *E04B 1/98* (2013.01); *E04C 2/205* (2013.01); *E04D 13/1415* (2013.01); *E04D 13/151* (2013.01); *E04B 1/681* (2013.01)

(58) Field of Classification Search
CPC ..... E04B 1/6806; E04B 1/681; E04C 2/205; E04D 13/151; E04D 13/1415
See application file for complete search history.

(56) References Cited

U.S. PATENT DOCUMENTS 1,357,713 A 11/1920 Lane
1,371,727 A 3/1921 Blickle
1,428,881 A 9/1922 Dyar
1,691,402 A 11/1928 Oden
1,716,994 A 6/1929 Wehrle
1,809,613 A 6/1931 Walker
2,010,569 A 8/1935 Sitzler
2,016,858 A 10/1935 Hall
2,035,476 A 3/1936 Herwood
2,152,189 A 4/1936 Henderson
2,069,899 A 2/1937 Older
2,190,532 A 2/1940 Lukomski
2,240,787 A 5/1941 Kinzer
2,271,180 A 1/1942 Brugger
2,277,286 A 3/1943 Bechtner
2,544,532 A 3/1951 Hill
2,701,155 A 2/1955 Estel, Jr.
2,776,865 A 1/1957 Anderson
2,828,235 A 3/1958 Holland et al.
2,954,592 A 10/1960 Parsons
2,995,056 A 10/1960 Knox
3,024,504 A 3/1962 Miller
3,080,540 A 3/1963 McFarland
3,111,069 A 11/1963 Farbish
3,124,047 A 3/1964 Graham
3,172,237 A 3/1965 Bradley
3,194,846 A 7/1965 Blaga
3,232,786 A 2/1966 Kellman
3,244,130 A 4/1966 Hipple, Jr.
3,245,328 A 4/1966 Fassbinder
3,255,680 A 6/1966 Cooper et al.
3,262,894 A 7/1966 Green
3,289,374 A 12/1966 Metz
3,298,653 A 1/1967 Omholt
3,300,913 A 1/1967 Patry et al.
3,302,690 A 2/1967 Hurd
3,335,647 A 8/1967 Thorp, Jr.
3,344,011 A 9/1967 Goozner
3,352,217 A 11/1967 Peters et al.
3,355,846 A 12/1967 Tillson
3,363,383 A 1/1968 Barge
3,371,456 A 3/1968 Balzer et al.
3,372,521 A 3/1968 Thom
3,378,958 A 4/1968 Parks et al.
3,394,639 A 7/1968 Viehmann
3,410,037 A * 11/1968 Empson ..... E04D 13/151 52/309.9
3,435,574 A 4/1969 Hallock
3,447,430 A 6/1969 Gausepohl
3,470,662 A 10/1969 Kellman
3,482,492 A 12/1969 Bowman
3,543,459 A 12/1970 Mills
3,551,009 A 12/1970 Cammuso et al.
3,575,372 A 4/1971 Emberson
3,582,095 A 6/1971 Bogaert et al.
3,603,048 A 9/1971 Hadfield
3,604,322 A 9/1971 Koster
3,606,826 A 9/1971 Bowman
3,629,986 A 12/1971 Klittich
3,643,388 A 2/1972 Parr et al.
3,659,390 A 5/1972 Balzer et al.
3,670,470 A 6/1972 Thom
3,672,707 A 6/1972 Russo et al.
3,677,145 A 7/1972 Wattiez
3,694,976 A 10/1972 Warshaw
3,712,188 A 1/1973 Aiorson
3,720,142 A 3/1973 Pare
3,724,155 A * 4/1973 Reeve ..... E04D 13/151 52/396.04
3,736,713 A 6/1973 Flachbarth et al.
3,742,669 A 7/1973 Mansfeld
3,745,726 A 7/1973 Thom
3,750,359 A 8/1973 Balzer et al.
3,760,544 A 9/1973 Hawes et al.
3,797,188 A 3/1974 Mansfeld
3,849,958 A 11/1974 Balzer et al.
3,856,839 A 12/1974 Smith et al.
3,871,787 A 3/1975 Stegmeier
3,880,539 A 4/1975 Brown
3,883,475 A 5/1975 Racky et al.
3,896,511 A 7/1975 Cuschera
3,907,443 A 9/1975 McLean
3,911,635 A 10/1975 Traupe
3,934,905 A 1/1976 Lockard
3,944,704 A 3/1976 Dirks
3,951,562 A 4/1976 Fyfe
3,956,557 A 5/1976 Hurst
3,974,609 A 8/1976 Attaway
4,007,994 A 2/1977 Brown
4,018,017 A 4/1977 Schoop
4,018,539 A 4/1977 Puccio
4,022,538 A 5/1977 Watson et al.
4,030,156 A 6/1977 Raymond
4,055,925 A 11/1977 Wasserman et al.
4,058,947 A † 11/1977 Earle et al.
4,066,578 A 1/1978 Murch et al.
4,129,967 A 12/1978 Barlow
4,132,491 A 1/1979 Scheffel
4,134,875 A 1/1979 Tapia
4,140,419 A 2/1979 Puccio
4,143,088 A 3/1979 Favre et al.
4,146,939 A 4/1979 Izzi
4,174,420 A 11/1979 Anolick et al.

(56) References Cited

U.S. PATENT DOCUMENTS 4,181,711 A 1/1980 Ohashi et al.
4,204,856 A 5/1980 Yigdall et al.
4,216,261 A 8/1980 Dias
4,221,502 A 9/1980 Tanikawa
4,224,374 A 9/1980 Priest
4,237,182 A 12/1980 Fulmer et al.
4,245,925 A 1/1981 Pyle
4,246,313 A 1/1981 Stengle, Jr.
4,258,606 A 3/1981 Wilson
4,270,318 A 6/1981 Carroll et al.
4,271,650 A 6/1981 Lynn-Jones
4,288,559 A † 9/1981 Illger
4,290,249 A 9/1981 Mass
4,290,713 A 9/1981 Brown et al.
4,295,311 A 10/1981 Dahlberg
4,305,680 A 12/1981 Rauchfuss, Jr.
4,320,611 A 3/1982 Freeman
4,359,847 A 11/1982 Schukolinski
4,362,428 A * 12/1982 Kerschner ..... E01C 11/106 404/64
4,367,976 A 1/1983 Bowman
4,374,207 A 2/1983 Stone et al.
4,374,442 A 2/1983 Hein et al.
4,401,716 A 8/1983 Tschudin-Mahrer
4,424,956 A 1/1984 Grant et al.
4,431,691 A 2/1984 Greenlee
4,432,465 A 2/1984 Wuertz
4,433,732 A 2/1984 Licht et al.
4,447,172 A 5/1984 Galbreath
4,453,360 A 6/1984 Barenberg
4,455,396 A 6/1984 Al-Tabacichall et al.
4,473,015 A 9/1984 Hounsel
4,486,994 A 12/1984 Fisher et al.
4,494,762 A 1/1985 Geipel
4,533,278 A 8/1985 Corsover et al.
4,558,875 A 12/1985 Yamaji et al.
4,564,550 A 1/1986 Tschudin-Mahrer
4,566,242 A 1/1986 Dunsworth
4,576,841 A 3/1986 Lingemann
4,589,242 A 5/1986 Moulinie et al.
4,615,411 A 10/1986 Breitscheidel et al.
4,620,330 A 11/1986 Izzi, Sr.
4,620,407 A 11/1986 Schmid
4,622,251 A 11/1986 Gibb
4,637,085 A * 1/1987 Hartkorn ..... E01D 19/06 14/73.1
4,687,829 A 8/1987 Chaffee et al.
4,693,652 A 9/1987 Sweeney
4,711,928 A 12/1987 Lee et al.
4,717,050 A 1/1988 Wright
4,745,711 A 5/1988 Box
4,751,024 A 6/1988 Shu et al.
4,756,945 A 7/1988 Gibb
4,767,655 A 8/1988 Tschudin-Mahrer
4,773,791 A 9/1988 Hartkorn
4,780,571 A 10/1988 Huang
4,781,003 A 11/1988 Rizza
4,784,516 A 11/1988 Cox
4,791,773 A 12/1988 Taylor
4,807,843 A 2/1989 Courtois et al.
4,815,247 A 3/1989 Nicholas
4,824,283 A 4/1989 Belangie
4,835,130 A 5/1989 Box
4,839,223 A 6/1989 Tschudin-Mahrer
4,848,044 A 7/1989 LaRoche et al.
4,849,223 A 7/1989 Pratt et al.
4,866,898 A * 9/1989 LaRoche ..... E04B 1/6804 52/396.01
4,879,771 A 11/1989 Piskula
4,882,890 A * 11/1989 Rizza ..... E04D 13/151 52/396.05
4,885,885 A 12/1989 Gottschling
4,893,448 A 1/1990 McCormick
4,901,488 A 2/1990 Murota et al.
4,911,585 A 3/1990 Vidal et al.
4,916,878 A * 4/1990 Nicholas ..... E04B 1/6803 404/47
4,920,725 A 5/1990 Gore
4,927,291 A 5/1990 Belangie
4,932,183 A 6/1990 Coulston
4,942,710 A * 7/1990 Rumsey ..... E04B 1/6815 404/68
4,952,615 A 8/1990 Welna
4,957,798 A 9/1990 Bogdany
4,965,976 A * 10/1990 Riddle ..... E04B 1/6803 52/396.05
4,977,018 A 12/1990 Irrgeher et al.
4,992,481 A 2/1991 von Bonin et al.
5,007,765 A 4/1991 Dietlein et al.
5,013,377 A 5/1991 Lafond
5,024,554 A 6/1991 Benneyworth et al.
5,026,609 A 6/1991 Jacob et al.
5,035,097 A 7/1991 Cornwall
5,053,442 A 10/1991 Chu et al.
5,060,439 A 10/1991 Clements et al.
5,071,282 A 12/1991 Brown
5,072,557 A 12/1991 Naka et al.
5,082,394 A 1/1992 George
5,094,057 A 3/1992 Morris
5,115,603 A 5/1992 Blair
5,120,584 A 6/1992 Ohlenforst et al.
5,121,579 A 6/1992 Hamar et al.
5,129,754 A 7/1992 Brower
5,130,176 A 7/1992 Baerveldt
5,137,937 A 8/1992 Huggard et al.
5,140,797 A 8/1992 Gohike et al.
5,168,683 A 12/1992 Sansom et al.
5,173,515 A 12/1992 von Bonin et al.
5,190,395 A 3/1993 Cathey et al.
5,209,034 A 5/1993 Box et al.
5,213,441 A * 5/1993 Baerveldt ..... E01D 19/06 404/66
5,222,339 A 6/1993 Hendrickson et al.
5,249,404 A 10/1993 Leek et al.
5,270,091 A 12/1993 Krysiak et al.
5,297,372 A 3/1994 Nicholas
5,327,693 A 7/1994 Schmid
5,335,466 A 8/1994 Langohr
5,338,130 A 8/1994 Baerveldt
5,354,072 A 10/1994 Nicholson
5,365,713 A * 11/1994 Nicholas ..... E04B 1/681 52/396.03
5,367,850 A 11/1994 Nicholas
5,380,116 A 1/1995 Colonias
5,436,040 A 7/1995 Lafond
5,441,779 A 8/1995 Lafond
5,443,871 A 8/1995 Lafond
5,450,806 A 9/1995 Jean
5,456,050 A 10/1995 Ward
5,472,558 A 12/1995 Lafond
5,479,745 A 1/1996 Kawai et al.
5,485,710 A 1/1996 Lafond
5,489,164 A 2/1996 Tusch et al.
5,491,953 A 2/1996 Lafond
5,498,451 A 3/1996 Lafond
5,501,045 A 3/1996 Wexler
5,508,321 A 4/1996 Brebner
5,528,867 A 6/1996 Thompson
RE35,291 E 7/1996 Lafond
5,572,920 A 11/1996 Kennedy et al.
5,607,253 A 3/1997 Almstrom
5,611,181 A 3/1997 Shreiner et al.
5,616,415 A 4/1997 Lafond
5,628,857 A * 5/1997 Baerveldt ..... B29D 99/0053 156/244.25
5,635,019 A 6/1997 Lafond
5,649,784 A 7/1997 Ricaud et al.
5,650,029 A 7/1997 Lafond
5,656,358 A 8/1997 Lafond
5,658,645 A 8/1997 Lafond
5,664,906 A 9/1997 Baker et al.
5,680,738 A 10/1997 Allen et al.
5,686,174 A 11/1997 Irrgeher
5,691,045 A 11/1997 Lafond

(56) References Cited

U.S. PATENT DOCUMENTS 5,744,199 A † 4/1998 Joffre
5,759,665 A 6/1998 Lafond
5,762,738 A 6/1998 Lafond
5,765,332 A 6/1998 Landin et al.
5,773,135 A 6/1998 Lafond
5,791,111 A 8/1998 Beenders
5,806,272 A 9/1998 Lafond
5,813,191 A 9/1998 Gallagher
5,830,319 A 11/1998 Landin
5,851,609 A 12/1998 Baratuci et al.
5,875,598 A 3/1999 Batten et al.
5,876,554 A 3/1999 Lafond
5,878,448 A 3/1999 Molter
5,887,400 A 3/1999 Bratek et al.
5,888,341 A 3/1999 Lafond
5,935,695 A 8/1999 Baerveldt
5,957,619 A 9/1999 Kinoshita et al.
5,974,750 A 11/1999 Landin et al.
5,975,181 A 11/1999 Lafond
6,001,453 A 12/1999 Lafond
6,014,848 A 1/2000 Hillburn, Jr.
6,035,536 A 3/2000 Dewberry
6,035,587 A 3/2000 Dressler
6,035,602 A 3/2000 Lafond
6,039,503 A 3/2000 Cathey
D422,884 S 4/2000 Lafond
6,088,972 A 6/2000 Johanneck
6,102,407 A 8/2000 Moriya et al.
6,115,980 A 9/2000 Knak et al.
6,115,989 A 9/2000 Boone et al.
6,128,874 A * 10/2000 Olson ..... E04B 1/948 52/232
6,131,352 A 10/2000 Bames et al.
6,131,364 A 10/2000 Peterson
6,131,368 A 10/2000 Tramposch et al.
6,138,427 A 10/2000 Houghton
6,148,890 A 11/2000 Lafond
6,158,915 A 12/2000 Kise
6,189,573 B1 2/2001 Ziehm
6,192,652 B1 2/2001 Goer et al.
6,207,085 B1 3/2001 Ackerman
6,207,089 B1 3/2001 Chuang
6,219,982 B1 4/2001 Eyring
6,237,303 B1 5/2001 Allen et al.
6,250,358 B1 6/2001 Lafond
6,253,514 B1 7/2001 Jobe et al.
6,329,030 B1 12/2001 Lafond
6,350,373 B1 2/2002 Sondrup
6,351,923 B1 3/2002 Peterson
6,355,328 B1 3/2002 Baratuci et al.
6,368,670 B1 4/2002 Frost et al.
6,419,237 B1 7/2002 More
6,439,817 B1 8/2002 Reed
6,443,495 B1 9/2002 Harmeling
6,460,214 B1 10/2002 Chang
6,491,468 B1 12/2002 Hagen
6,499,265 B2 12/2002 Shreiner
6,532,708 B1 3/2003 Baerveldt
6,544,445 B1 4/2003 Graf et al.
6,552,098 B1 4/2003 Bosch et al.
6,574,930 B2 6/2003 Kiser
6,581,341 B1 6/2003 Baratuci et al.
6,598,634 B1 7/2003 Pelles
6,665,995 B2 12/2003 Deane
6,666,618 B1 12/2003 Anaya et al.
6,685,196 B1 2/2004 Baerveldt
6,820,382 B1 11/2004 Chambers et al.
6,860,074 B2 3/2005 Stanchfield
6,862,863 B2 3/2005 McCorkle et al.
6,877,292 B2 4/2005 Baratuci et al.
6,897,169 B2 5/2005 Matsui et al.
6,905,650 B2 6/2005 McIntosh et al.
6,948,287 B2 9/2005 Kom
6,989,188 B2 1/2006 Brunnhofer et al.
6,996,944 B2 2/2006 Shaw
7,043,880 B2 5/2006 Morgan et al.
7,070,653 B2 7/2006 Frost et al.
7,090,224 B2 8/2006 Iguchi et al.
7,101,614 B2 9/2006 Anton et al.
7,114,899 B2 10/2006 Gass et al.
7,210,557 B2 5/2007 Phillips et al.
7,222,460 B2 5/2007 Francies, III et al.
7,225,824 B2 6/2007 West et al.
7,240,905 B1 7/2007 Stahl, Sr.
7,278,450 B1 10/2007 Condon
7,287,738 B2 10/2007 Pitlor
7,441,375 B2 10/2008 Lang
7,621,731 B2 11/2009 Armantrout et al.
7,665,272 B2 2/2010 Reen
7,678,453 B2 3/2010 Ohnstad et al.
7,748,310 B2 7/2010 Kennedy
7,757,450 B2 7/2010 Reyes et al.
7,836,659 B1 11/2010 Barnes
7,856,781 B2 12/2010 Hillburn, Jr.
7,877,958 B2 2/2011 Baratuci et al.
7,941,981 B2 5/2011 Shaw
8,033,073 B1 10/2011 Binder
8,079,190 B2 12/2011 Hilburn, Jr.
8,171,590 B2 5/2012 Kim
8,172,938 B2 5/2012 Alright et al.
8,317,444 B1 11/2012 Hensley
8,333,532 B2 12/2012 Derrigan et al.
8,341,908 B1 1/2013 Hensley et al.
8,365,495 B1 2/2013 Witherspoon
8,397,453 B2 3/2013 Shaw
8,601,760 B2 12/2013 Hilburn, Jr.
8,720,138 B2 5/2014 Hilburn, Jr.
8,739,495 B1 6/2014 Witherspoon
8,813,449 B1 8/2014 Hensley et al.
8,813,450 B1 8/2014 Hensley et al.
9,068,297 B2 6/2015 Hensley et al.
9,200,437 B1 12/2015 Hensley et al.
2002/0052425 A1 5/2002 Kaku et al.
2002/0088192 A1 7/2002 Calixto
2002/0095908 A1 7/2002 Kiser
2002/0113143 A1 8/2002 Frost et al.
2002/0193552 A1 12/2002 Kiuchi et al.
2003/0005657 A1 1/2003 Visser et al.
2003/0110723 A1 6/2003 Baerveldt
2003/0213211 A1 11/2003 Morgan et al.
2004/0020162 A1 2/2004 Baratuci et al.
2004/0024077 A1 2/2004 Braun et al.
2004/0045234 A1 3/2004 Morgan et al.
2004/0101672 A1 5/2004 Anton et al.
2004/0113390 A1 6/2004 Broussard, III
2004/0163724 A1 8/2004 Trabbold et al.
2005/0005553 A1 1/2005 Baerveldt
2005/0066600 A1 3/2005 Moulton et al.
2005/0095066 A1 5/2005 Warren
2005/0120660 A1 6/2005 Kim et al.
2005/0136761 A1 6/2005 Murakami et al.
2005/0155305 A1 7/2005 Cosenza et al.
2005/0193660 A1 9/2005 Mead
2005/0222285 A1 10/2005 Massengill et al.
2006/0010817 A1 1/2006 Shull
2006/0030227 A1 2/2006 Hairston et al.
2006/0117692 A1 6/2006 Trout
2006/0178064 A1 8/2006 Balthes et al.
2007/0059516 A1 3/2007 Vincent et al.
2007/0137135 A1 6/2007 Shymkowich
2007/0199267 A1 8/2007 Moor
2007/0261342 A1 11/2007 Cummings
2008/0172967 A1 7/2008 Hilburn
2008/0193738 A1 8/2008 Hensley et al.
2008/0268231 A1 10/2008 Deib
2009/0036561 A1 2/2009 Nygren
2009/0223150 A1 9/2009 Baratuci et al.
2009/0223159 A1 9/2009 Colon
2009/0246498 A1 10/2009 Deiss
2009/0315269 A1 12/2009 Deiss
2010/0058696 A1 3/2010 Mills
2010/0275539 A1 11/2010 Shaw
2010/0281807 A1 11/2010 Bradford
2010/0319287 A1 12/2010 Shaw

(56) References Cited

U.S. PATENT DOCUMENTS

| | | | |
|---|---|---|---|
| 2011/0016808 | A1 | 1/2011 | Hulburn, Jr. |
| 2011/0083383 | A1 | 4/2011 | Hilburn, Jr. |
| 2011/0088342 | A1 | 4/2011 | Stahl, Sr. et al. |
| 2011/0135387 | A1 | 6/2011 | Derrigan et al. |
| 2011/0247281 | A1 | 10/2011 | Pilz et al. |
| 2012/0117900 | A1 | 5/2012 | Shaw |
| 2014/0151968 | A1 | 6/2014 | Hensley et al. |
| 2014/0219719 | A1 | 8/2014 | Hensley et al. |
| 2014/0360118 | A1 | 12/2014 | Hensley et al. |

FOREIGN PATENT DOCUMENTS

| | | | |
|---|---|---|---|
| CA | 1259351 | A | 9/1989 |
| CA | 1280007 | | 2/1991 |
| CA | 2256660 | A1 | 2/2000 |
| CA | 2296779 | C | 11/2006 |
| CA | 2640007 | A1 | 3/2009 |
| DE | 4436280 | A1 | 4/1996 |
| DE | 19809973 | C1 | 7/1999 |
| DE | 102005054375 | A1 | 5/2007 |
| EP | 0976882 | A2 | 2/1992 |
| EP | 0942107 | A2 | 9/1999 |
| EP | 1118715 | A1 | 7/2001 |
| EP | 1118726 | A1 | 7/2001 |
| EP | 1540220 | A1 | 2/2004 |
| EP | 1540220 | B1 | 8/2006 |
| EP | 1983119 | A1 | 4/2007 |
| EP | 1983119 | B1 | 10/2008 |
| GB | 977929 | | 12/1964 |
| GB | 1359734 | | 7/1974 |
| GB | 1495721 | | 12/1977 |
| GB | 1519795 | | 8/1978 |
| GB | 2181093 | A | 4/1987 |
| GB | 2251623 | A1 | 7/1992 |
| GB | 2359265 | A | 8/2001 |
| GB | 2377379 | A | 1/2003 |
| JP | 200645950 | A | 2/2006 |
| WO | 2003006109 | A1 | 1/2003 |
| WO | 2007023118 | A2 | 3/2007 |
| WO | 2007024246 | A1 | 3/2007 |

OTHER PUBLICATIONS

Willseal LLC, Product Data Sheet, Willseal FR-H, Horizontal 2 and 3 hour fire rated seal, labeled Copyright 2013, pp. 1-2.
Schul International Co., LLC., Firejoint 2FR-V, Fire Rated Expansion Joint- 2 Hour Fire Rated, labeled Copyright 2012, pp. 1-2.
Nillseal LLc, Product Data Sheet, Willseal FR-V, Vertical 2 and 3 hour fire rated seal, labeled Copyright 2013, pp. 1-2.
UL Online Certifications Directory, System No. FF-D-0082, XHBN. FF-D-0082 Joint Systems, Jul. 29, 2013, pp. 1-2.
UL Online Certifications Directory, System No. FF-D-1100, XHBN. FF-D-1100 Joint Systems, Sep. 24, 2012, pp. 1-2.
UL Online Certifications Directory, System No. WW-D-2013, XHBN. WW-D-2013 Joint Systems, May 27, 2004, pp. 1-2.
UL Online Certifications Directory, System No. FF-D-2008, XHBN. FF-D-2008 Joint Systems, Mar. 31, 2003, pp. 1-2.
UL Online Certifications Directory, System No. FF-D-1053, XHBN. FF-D-1053 Joint Systems, Nov. 28, 2007, pp. 1-2.
UL Online Certifications Directory, System No. WW-D-3005, XHBN. WW-D-3005 Joint Systems, Nov. 15, 1999, pp. 1-2.
UL Online Certifications Directory, XHHW.R8196 Fill, Void or Cavity Materials, labeled Copyright 2014, pp. 1.
UL Online Certifications Directory, XHBN.FF-D-0075 Joint Systems, Apr. 30, 2010, pp. 1-2.
UL Online Certifications Directory, System No. FF-D-0075, XHBN. FF-D-0075 Joint Systems, Aug. 21, 2014, pp. 1-2.
UL Online Certifications Directory, XHBN.FF-D-0094 Joint Systems, Sep. 11, 2013, pp. 1-2.
UL Online Certifications Directory, XHBN.FF-D-1121 Joint Systems, Apr. 25, 2013, pp. 1-2.
UL Online Certifications Directory, System No. FF-D-2006, XHBN. FF-D-2006 Joint Systems, Jun. 28, 2002, pp. 1-3.
Underwriters Laboratories (UK) Ltd., Assessment Report, Project No. 12CA37234, Aug. 24, 2012, pp. 1-20.
Emseal Joint Systems, Ltd., 2 inch Quietjoint—concrete to concrete, Part No. SHH_2_WW_CONC, Mar. 25, 2014, p. 1.
Emseal Joint Systems, Ltd., 2 inch Quietjoint—gypsum to gypsum, Part No.: SHH_2_WW_GYP, Mar. 25, 2014, p. 1.
Emseal Joint Systems, Ltd., 2 inch Quietjoint at concrete wall to window, Part No. SHG_2_WW_CONC_TO_GLASS_INSIDE_CORNER, Mar. 25, 2014, p. 1.
Emseal Joint Systems, Ltd., 2 inch Quietjoint at Gypsum Wall to Window, Part No. SHG_2_WW_GL_INSIDE_CORNER_GYNP, Mar. 25, 2014, p. 1.
Emseal Joint Systems, Ltd., 2 inch Quietjoint—Concrete to Concrete at Head of Wall, Part No. SHH_2_HW_CONC_INSIDE_CORNER, Mar. 25, 2014, p. 1.
Emseal Joint Systems, Ltd., 2 inch Quietjoint—Gypsum to Concrete at Head of Wall, Part No. SHH_HW_GYP_CONC_INSIDE_CORNER, Mar. 25, 2014, p. 1.
Emseal Joint Systems, Ltd., 2 inch Quietjoint at Wall Partition to Window, Part No. SHG_2_WW_GL_INSIDE_CORNER_WALL_PARTITION_WINDOW, Mar. 25, 2014, p. 1.
Emseal Joint Systems, Ltd., Emshield DFR3 MSDS, last modified Sep. 3, 2014, p. 1.
https://www.google.com/search, seismic colorseal 5130176 "5,130,176", printed on Oct. 12, 2014, p. 1.
http://www.amazon.com, search for emseal 8,739,495, 1-16 of 624 results for emseal 8,739,495, printed on Oct. 13, 2014, pp. 1-5.
http://www.amazon.com/QuietJoint-Acoustic-Partition-Closure-2-sided, QuietJoint Acoustic Partition Closure for 3 inch (75mm) Joint, 10 foot (3m), printed on Sep. 29, 2014, pp. 1-3.
http://www.amazon.com/QuietJoint-Acoustic-Partition-Closure-3-sided, QuietJoint Acoustic Partition Closure for 5/8 inch (15 mm) Joint, 10 foot (3m), printed on Oct. 13, 2014, pp. 1-3.
Illbruck, Illmod 2d, Product Information, 2002, pp. 1-2.
Emseal Joint Systems, Ltd., Laminations as a Build Choice—The Anatomy of Quality in Pre-Compressed Foam Sealants, last modified Jul. 30, 2013, pp. 1-3.
Snapshot of Office Action issued in U.S. Appl. No. 90/013,395; printed in 2015, 48 pages.
Snapshot of Office Action issued in U.S. Appl. No. 90/013,428); printed in 2015, 23 pages.
Snapshot of Office Action issued in U.S. Appl. No. 90/013,472; printed in 2015, 22 pages.
Snapshot of Office Action issued in U.S. Appl. No. 90/013,473; printed in 2015, 22 pages.
3M; Fire Barrier CP 25WB-FCaulk, Product Data Sheet, Copyright 3M 2001, 4 pages.
Tremco Incorporated, "Firestop Submittal" Data Sheet collections, Certificate of Conformance dated Nov. 2004, 47 pages; publication date unknown from document.
Snapshot of Final Office Action for U.S. Appl. No. 90/013,473; dated Nov. 6, 2015, 38 pages.
ACI 504-R, Guide to Sealing Joint in Concrete Structures, ACI Committee 504, 1997, 44 pages.
Decision Granting Ex Parte Reexamination on Control No. 90/013,565; Sep. 29, 2015, 19 pages.
Emseal Joint Systems, Lt., Preformed Sealants and Expansion Joint Systems, May 2002, pp. 1-4.
Emseal Joint System, Ltd., Tech Data DSH System, Jan. 2000, pp. 1-2.
Emseal Joint Systems, Ltd., Emseal CAD.dwg, Oct. 2000, pp. 1-7.
Emseal Joint Systems, Ltd., Installation Instructions: AST & IST Sealant Tapes, Dec. 1998, p. 1.
Emseal Joint Systems, Ltd., Emshield WFR2, Fire-Rated Expansion Joint Product Data, Jun. 2009, pp. 1-2.
Emseal Joint System, Ltd., 1/2 Inch Colorseal, Binary Seal System Components, document dated Nov. 24, 1992, p. 1.
Snapshot of Office Action for U.S. Appl. No. 13/731,327; dated Jan. 4, 2017, 6 pages.
Snapshot of Notice of Allowance for U.S. Appl. No. 14/229,463; dated Jan. 5, 2017, 7 pages.

(56) References Cited

OTHER PUBLICATIONS

Snapshot of Notice of Allowance for U.S. Appl. No. 13/731,327; dated Feb. 10, 2017, 5 pages.
Snapshot of Advisory Action for U.S. Appl. No. 90/013,395; dated Sep. 14, 2016, 16 pages.
Snapshot of Intent to Issue Ex Parte Reexamination Certificate for U.S. Appl. No. 90/013,511; dated Sep. 21, 2016, 9 pages.
Snapshot of Intent to Issue Ex Parte Reexamination Certificate for U.S. Appl. No. 90/013,395; dated Oct. 6, 2016, 9 pages.
Snapshot of Intent to Issue Ex Parte Reexamination Certificate for U.S. Appl. No. 90/013,565; dated Oct. 7, 2016, 9 pages.
Dow Coming 890 Self-Leveling Silicone Joint Sealant; Dow Coming Corporation; 1996, 1999.
Snapshot of Advisory Action for U.S. Appl. No. 90/013,428; dated Sep. 8, 2016, 13 pages.
Snapshot of Intent to Issue Ex Parte Reexamination Certificate for U.S. Appl. No. 90/013,428; dated Oct. 31, 2016, 7 pages.
Snapshot of Ex Parte Reexamination Certificate for U.S. Appl. No. 90/013,511; dated Oct. 31, 2016, 3 pages.
Snapshot of Ex Parte Reexamination Certificate for U.S. Appl. No. 90/013,565; dated Nov. 2, 2016, 3 pages.
www.stifirestop.com, Specified Technologies, Inc., Product Data Sheet, Series ES Elastomeric Sealant, Copyright 2004, pp. 1-4.
www.stifirestop.com, Specified Technologies, Inc., Product Data Sheet, Pensil PEN300 Silicone Sealant, Copyright 2004, pp. 1-4.
Snapshot of Office Action issued in U.S. Appl. No. 14/540,514; printed in 2015, 22 pages.
Snapshot of Notice of Allowance for U.S. Appl. No. 12/635,062; dated Oct. 9, 2015, 5 pages.
Snapshot of Office Action for U.S. Appl. No. 90/013,511; dated Oct. 23, 2015, 28 pages.
Snapshot of Non-Final Office Action for U.S. Appl. No. 13/731,327; dated Mar. 18, 2016, 27 pages.
Snapshot of Final Office Action for U.S. Appl. No. 14/211,694; dated Mar. 21, 2016, 16 pages.
Snapshot of Final Office Action for U.S. Appl. No. 14/455,398; dated Mar. 29, 2016, 12 pages.
Snapshot of Ex Parte Reexamination Certificate No. U.S. Pat. No. 6,532,708C1 for U.S. Appl. No. 90/013,472; dated Mar. 23, 2016, 3 pages.
Snapshot of Notice of Allowance for U.S. Appl. No. 14/511,394, dated Feb. 17, 2017, 5 pages.
Snapshot of Notice of Allowance for U.S. Appl. No. 14/455,398; dated Mar. 13, 2017, 9 pages.
Snapshot of Notice of Allowance for U.S. Appl. No. 13/729,500; dated Mar. 15, 2017, 9 pages.
Snapshot of Notice of Allowance for U.S. Appl. No. 14/278,210; dated Mar. 13, 2017, 8 pages.
Iso-Chemie, ISO BLOCO 600 solukumitiiviste, Finnish language, pp. 1-2; publication date unknown from document.
Iso-Chemie, ISO BLOCO 600, Produktbeskrivelse, Norwegian language, pp. 1-2, publication date unknown from document.
Ashida, Polyurethane and Related Foams, Chapter three: Fundamentals, p. 43, 45. pp. 1-3; publication date unknown from document.
Merritt, Protection against Hazards, Section 3.30-3.31, 1994, pp. 1-4.
Schultz, Fire and Flammability Handbook, p. 363, 1985, pp. 1-3.
Netherlands Standards Institute, Fire resistance tests for non-loadbearing elements—Part 1: Walls, Aug. 1999, NEN-EN 1364-1, pp. 1-32.
Troitzsch, Jurgen, International plastics flammability handbook, 1983, pp. 1-2.
Polytite Manufacturing Company, Polytite "R" Colorized Joint Sealant, Jan. 7, 1998, pp. 1-2.
Quelfire, Passive Fire Protection Products, catalog, pp. 1-68, publication date unknown from document.
Quelfire, Intufoam, pp. 1-4, publication date unknown from document.
Saint-Gobain Performance Plastics, Norseal V740, labeled Copyright 2001, pp. 1-2.
Sandell Manufacturing Company, Inc., Polytite Sealant and Construction Gasket, p. 1, publication date unknown from document.
Schul International Corporation, Hydrostop, Expansion Joint System, Jan. 17, 2001, pp. 1-2.
Illbruck, Sealtite-willseal, Plant Bodenwohr, pp. 1-17, publication date unknown from document.
Schul International Co., LLC., Sealtite "B" Type II, Part of the S3 Sealant System, Jan. 5, 2006, pp. 1-2.
Sealtite-willseal Joint Sealants, Equivalency Chart for Joint Sealants, p. 1, publication date unknown from document.
Schul International Co., LLC., Material Safety Data Sheet, Seismic Sealtite, revised date Oct. 23, 2002, pp. 1-3.
Sealtite-Willseal, Installation Procedures for Seismic Sealtite/250C Joint Sealant, Mar. 4, 2001, p. 1.
Tremco Illbruck Ltd., Technical Data Sheet, ALFASIL FR, Issue 3, pp. 1-2, Oct. 22, 2007.
Product Data Sheet, Art. No. 4.22.01 Compriband MPA, pp. 1-2, publication date unknown from document.
UL Online Certifications Directory, XHBN.Guidelnfo, Joint Systems, last updated Sep. 21, 2013, pp. 1-4.
UL 1715 Fire Test of Interior Finish Material, http://ulstandardsinfonet.ul.com/scopes/1715.html[Oct. 7, 2014 3:27:15 PM], p. 1, publication date unknown from document.
Williams Products, Inc., Williams Everlastic 1715 Fire Classified Closures Tech Data, Oct. 2005, p. 1.
Williams Products, Inc., Everlastic Fire Classifed Closures 1715, http://williamsproducts.net/fire_classified_1715.html [Oct. 7, 2014 3:26:33 PM], pp. 1-3, publication date unknown from document.
Williams Products, Inc., Installation for partion closures, p. 1, publication date unknown from document.
Will-Seal Construction Foams, Will-seal is Tested to Perform, p. 1, publication date unknown from document.
Will-Seal Precompressed Foam Sealant, How Will-Seal Works, p. 1, publication date unknown from document.
Illbruck, Will-Seal, Basis of Acceptance, 3.0 Construction Requirements, Precompressed Foam Sealants, Section 07915, pp. 1-8, publication date unknown from document.
Emseal Joint Systems, Ltd., Emseal Colorseal Tech Data, Jul. 2009, p. 1-2.
Emseal Joint Systems, Ltd., Emseal Colorseal Tech Data, Mar. 2011, p. 1-2.
Emseal Joint Systems, Ltd., Emseal Horizontal Colorseal Tech Data, Aug. 2014, p. 1-2.
Emseal Joint Systems, Ltd., Emseal Seismic Colorseal Tech Data, Oct. 2009, pp. 1-2.
Emseal Joint Systems, Ltd., Emseal Seismic Colorseal Tech Data, Jun. 2010, pp. 1-2.
Emseal Joint Systems, Ltd., Emseal MST, Multi-Use Sealant Tape, Sep. 2008, pp. 1-2.
Emseal Joint Systems, Ltd., Emseal MST, Multi-Use Sealant Tape, Oct. 2013, pp. 1-2.
Emseal Joint Systems, Ltd., Emshield DFR2 System, Tech Data, Sep. 2014, pp. 1-4.
Emseal Joint Systems, Ltd., Emshield DFR2, last modified Sep. 19, 2014, pp. 1-4.
Emseal Joint Systems, Ltd., Emshield DFR3, last modified Sep. 4, 2014, pp. 1-5.
Emseal Joint Systems, Ltd., Emshield WFR2 and WFR3, last modified Sep. 3, 2014, pp. 1-5.
Emseal Joint Systems, Ltd., Colorseal-on-a-reel, last modified Nov. 10, 2014, pp. 1-3.
Emseal Joint Systems, Ltd., Colorseal, last modified Oct. 9, 2014, pp. 1-3.
Emseal GreyFlex Expanding Foam Sealant for Facades, p. 1, publication date unknown from document.
Emseal Joint Systems, Ltd., QuietJoint, Tech Data, Nov. 2012, pp. 1-2.
Emseal Corporation Ltd., Material Safety Data Sheet, QuietJoint, MSDS date May 13, 2014, pp. 1-2.
Emseal Joint Systems, Ltd., QuietJoint CAD Details, last modified Oct. 31, 2014, pp. 1-3.

(56) References Cited

OTHER PUBLICATIONS http://www.emseal.com/products/architectural/QuietJoint/QuietJoint.htm, QuietJoint Mass-Loaded Acoustic Partition Closure, last modified Oct. 9, 2014, pp. 1-4.
http://www.emseal.com/products/architectural/QuietJoint/QuietJoint.htm, QuietJoint Mass-Loaded Acoustic Partition Closure, last modified Jul. 29, 2014, pp. 1-4.
http://www.emseal.com/products/architectural/QuietJoint/QuietJoint.htm, QuietJoint Mass-Loaded Acoustic Partition Closure, No intumescent coating, last modified Sep. 19, 2014, pp. 1-4.
http://williamsproducts.net/wide.html, Everlastic Wide Joint Seal, http://williamsproducts.net/wide.html[Oct. 7, 2014 3:37:39 PM], pp. 1-3, publication date unknown from document.
Baerveldt, Konrad, The Applicator—Dear Tom: Emseal has two EIFS Expansion Joint Answers for you, Jun. 1991, pp. 1-4.
Salamander Industrial Products, Inc., blocoband HF—interior sealant, publication date unknown from document, 4 pages.
Snapshot of Office Action issued in U.S. Appl. No. 90/013,428; printed in 2015, 14 pages.
Snapshot of Notice of Allowance issued in U.S. Appl. No. 14/080,960; printed in 2015, 5 pages.
Decision Granting Ex Parte Reexamination on Control No. 90/013,473, dated May 19, 2015, 13 pages.
U.S. Appl. No. 60/953,703, filed Aug. 3, 2007 underlying U.S. Pat. No. 8,397,453, 24 pages.
Snapshot of Decision Granting Ex-Parte Reexamination issued in U.S. Appl. No. 90/013,472; printed in 2015; 25 pages.
Snapshot of Notice of Allowance issued in U.S. Appl. No. 14/229,463; printed in 2015; 8 pages.
Snapshot of Notice of Allowance issued in U.S. Appl. No. 13/731,327; printed in 2015, 8 pages.
Snapshot of Office Action issued in U.S. Appl. No. 14/211,694; printed in 2015, 14 pages.
Snapshot of Office Action issued in U.S. Appl. No. 13/652,021; printed in 2015, 13 pages.
Snapshot of Office Action issued in U.S. Appl. No. 90/013,511; printed in 2015, 24 pages.
Snapshot of Office Action issued in U.S. Appl. No. 14/278,210; printed in 2015, 11 pages.
Report on the Filing or Determination of an Action Regarding a Patent or Trademark, Docket No. 1:14-cv-358-SM, Filed Aug. 13, 2014 regarding U.S. Pat. No. 8,739,495, p. 1.
Report on the Filing or Determination of an Action Regarding a Patent or Trademark, Docket No. 1:14-cv-359-Pb, Filed Aug. 13, 2014 regarding U.S. Pat. No. 8,739,495, p. 1.
Plashes Flammability Handbook, pp. 52, 59, and 60, 3 pages; publication date unknown from document.
Defendants' Answer, Counterclaims, Affirmative Defenses, and Jury Demand, 1:14-cv-00359-PB, Doc. 11, filed Oct. 3, 2014, 20 pages.
Defendants' Objection to Plaintiffs Partial Motion to Dismiss, 1:14-cv-00358-SM, Doc. 24, tiled Nov. 10, 2014, pp. 1-3.
Defendants' Objection to Plaintiffs Motion to Strike Defendants' Tenth Affirmative Defense, 1:14-cv-00358-SM, Doc. 25, filed Nov. 12, 2014, pp. 1-3.
Defendants' Answer, Counterclaims, and Affirmative Defenses to Plaintiffs Consolidated Complaint, 1:14-cv-00358-SM, Doc. 38, filed Dec. 9, 2014, pp. 1-48.
Defendants' Objection to Plaintiffs Partial Motion to Dismiss Count III of Defendants' Counterclaim, 1:14-cv-00358-SM, Doc. 50, filed Jan. 16, 2015, pp. 1-15.
Defendants' Surreply to Plaintiffs Partial Motion to Dismiss Count II of Defendants' Counterclaims, 1:14-cv-00358-SM, Doc. 55, filed Feb. 13, 2015, pp. 1-6.
Joint Claim Construction and Prehearing Statement, 1:14-cv-00358-SM, Doc. 56, filed Mar. 3, 2015, pp. 1-9.
Lester Hensley, "Where's the Beef in Joint Sealants? Hybrids Hold the Key AWCI's Construction Dimensions", Jan. 2006, 3 pgs.
IsoChemie, Iso-Bloco 600, Correspondence of Jun. 8, 2006, 13 pages.
Shul International Company, Invoice #18925 to P. J. Spillane, Sep. 14, 2007, 5 pages.
Illbruck Inc., Tested Physical Properties, 1994, 1 page.
Andrea Frangi, Zum Brandverhalten von Holzdecken aus Hohlkastenelementen; Jun. 1999; 125 pages (English Translation).
Defendants' Joint First Amended Preliminary Invalidity Contentions received at MKG Mar. 17, 2015, 1:14-cv-00358-SM, 25 pgs. total.
Defendants' Joint First Amended Preliminary Invalidity Contentions received at MKG Mar. 17, 2015, Appendix A, 6 pgs.
Defendants' Joint First Amended Preliminary Invalidity Contentions received at MKG Mar. 17, 2015, Appendix B, 270 pgs.
Defendants' Joint First Amended Preliminary Invalidity Contentions received at MKG Mar. 17, 2015, Appendix B, 376 pgs.
Defendants' Joint First Amended Preliminary Invalidity Contentions received at MKG Mar. 17, 2015, Appendix C, 125 pgs.
Defendants' Joint First Amended Preliminary Invalidity Contentions received at MKG Mar. 17, 2015, Appendix D, 4 pgs.
IBMB, Test Report No. 3263/5362, Jul. 18, 2002, English Translation, 14 pgs.
IBMB, Test Report No. 3263/5362, Jul. 18, 2002, German, 13 pgs.
IBMB, Test Certificate No. 3002/2719, Mar. 22, 2000, English Translation, 14 pgs.
IBMB, Test Certificate No. P-3568/2560-MPA BS, Sep. 30, 2000, English Translation, 22 pgs.
IBMB, Test Certificate No. P-3568/2560-MPA BS, Sep. 30, 2000, German, 14 pgs.
IFT Rosenheim, Evidence of Performance Test Report 105 324691/e U, Apr. 19, 2006, 8 pgs.
Lester Hensley, "Where's the Beef in Joint Sealants? Hybrids Hold the Key," Applicator, vol. 23, No. 2, Spring 2001, pp. 1-5.
Emseal Joint Systems, LTD, Seismic Colorseal, Tech Data, Apr. 1998, pp. 1-2.
Schul International Co., LLC, Sealtite VP Premium Quality Precompressed Joint Sealant for Weather tight, Vapor Permeable, Vertical Applications, Technical Data, dated Oct. 28, 2005, pp. 1-2.
ISO-CHEMIE GmbH, Product Data Sheet, ISO-FLAME Kombi F 120, pp. 1-2, UK-F010514; publication date unknown from document.
Schul International Co., LLC, Seismic Sealtite II, Colorized, Precompressed Joint Sealant for Vertical Applications, Technical Data, dated Sep. 20, 2006, pp. 1-2.
Dow Corning Corporation, Dow Corning 790 Silicone Building Sealant, copyright date 1995, 1999, pp. 1-5.
Emseal Joint Systems, LTD, Horizontal Colorseal, Tech Data, Nov. 2008, pp. 1-2.
Emseal Joint Systems, LTD, Seismic Colorseal, Tech Data, Jul. 2009, pp. 1-2.
Emseal Joint Systems, LTD, Horizontal Colorseal, Tech Data, Jul. 2009, pp. 1-2.
Emseal Joint Systems, LTD, Horizontal Colorseal, Tech Data, Jun. 2010, pp. 1-2.
Schul International Co., LLC, Sealtite "B", Pre-compressed Joint Sealant, Premium Quality for Secondary Sealant Applications, Technical Data, dated Oct. 28, 2005, pp. 1-2.
ISO-Chemie Gmbh, ISO-FLAME Kombi F 120, 2006, German, pp. 1-2.
ISO-Chemie GmbH, Order Confirmation Sheet, dated Apr. 26, 2007, pp. 1-3.
ISO-Flame Kombi F 120, Net Price List, Schul International Co., dated Jun. 27, 2006, pp. 1.
Tremco Illbruck Limited, Compriband Super FR, Fire Rated Acrylic Impregnated Foam Sealant Strip, Issue 3, dated Apr. 12, 2007, pp. 1-2.
Figure 1: The BS 476; Part 20 & EN 1363-1 time temperature curve, pp. 1; publication date unknown from document.
Schul International Co., LLC, Sealtite, Premium Quality Precompressed Joint Sealant for Waterproof Vertical Applications, pp. 1; publication date unknown from document.
Schul International Co., LLC, Sealtite 50N, Premium Quality Pre-compressed Joint Sealant for Horizontal Applications, dated Oct. 28, 2005, pp. 1-2.

(56) References Cited

OTHER PUBLICATIONS

Will-Seal, Signed, Sealed & Delivered, pp. 1; publication date unknown from document.
Illbruck/USA, Will-Seal 150 Impregnanted Precompressed Expanding Foam Sealant Tape, Spec-Data Sheet, Joint Sealers, dated Nov. 1987, pp. 1-2.
Illbruck, Inc., Will-Seal 250 Impregnanted Precompressed Expanding Foam Sealant Tape, Spec-Data Sheet, Joint Sealers, dated Aug. 1989, pp. 1-2.
U.S. Department of Labor, Material Safety Data Sheet, Identity: Willseal 150/250 and/or E.P.S., date prepared Jul. 21, 1986, pp. 1-2.
Illbruck, TechSpec Division Facade & Roofing Solutions, ALFAS compriband, Mar. 2005, pp. 1-10.
Salamander Industrial Products, Inc., blocoband HF—interior sealant, pp. 1; publication date unknown from document.
Dow Corning Corporation, Dow Corning 790 Silicone Building Sealant, copyright 2000-2005, pp. 1-2.
Grace Fireproofing Products. Monokote Z-146T. 2007, pp. 1-2.
Polyurethane Foam Field Joint Infill Systems, Sep. 23, 2007 (via Snagit), PIH, pp. 1-5.
International Search Report and Written Opinion for PCT/US2014/032212, dated Aug. 25, 2014, pp. 1-13.
Grunau Illertissen Gmbh, Fir-A-Flex, Fire Protection for Linear Gaps in Walls and Ceilings, dated Aug. 1996, pp. 1-4.
UL Standard for Safety for Rests for Fire Resistance of Building Joint Systems, UL 2079, Underwriters Laboratories Inc. (UL); Fourth Edition; dated Oct. 21, 2004.
Emseal "Pre-cured-Caulk-and-Backerblock" Not New, Not Equal to Emseal's Colorseal, Jul. 19, 2012.
Emseal Drawing Part No. 010-0-00-00 dated Dec. 6, 2005.
Emseal Horizontal Colorseal Tech Data, dated Jun. 1997.
Emseal Joint Systems, Drawing SJS-100-CHT-N, Nov. 20, 2007.
Emseal Technical Bulletin, Benchmarks of Performance for High-Movement Acrylic-Impregnated, Precompressed, Foam Sealants when Considering Substitutions, Jul. 3, 2012.
Emseal, Colorseal & Seismic Colorseal, May 1997, Install Data Colorseal & Seismic Colorseal, p. 1-2.
Emseal, Colorseal, Jan. 2000, Colorseal TechData, p. 1-2.
Emseal, Is there a gap in your air barrier wall design?, Jul. 19, 2012.
Manfredi, L. "Thermal Degradation and Fire Resistance of Unsaturated Polyester, Modified Acrylic Resins and their Composites with Natural Fibres"; Science Direct, 2005.
Stein et al., "Chlorinated Paraffins as Effective Low Cost Flame Retardants for Polyethylene"; publication date unknown from document.
DIN 4102, Part 2, Fire Behaviour of Building Materials and Building Components, Sep. 1977.
Emseal Joint Systems, Ltd., Material Safety Data Sheet for AST-HI-ACRYLIC, pp. 1-2, date issued Apr. 2002.
ISO-Chemie, GmbH., Iso-Bloco 600, pp. 1-2, EN-B010706; publication date unknown from document.
ISO-Chemie, GmbH., Iso-Flame Kombi F 120, pp. 1-2., 2006.
Underwriters Laboratories Inc., UL Standard for Safety for Fire Tests of Building Construction and Materials, UL 263, Thirteenth Edition, Apr. 4, 2003, pp. 1-40.
Snapshot of Notice of Intent to Issue Ex Patent Reexamination Certificate for U.S. Appl. No. 90/013,472; dated Feb. 19, 2016, 8 pages.
Snapshot of Office Action for U.S. Appl. No. 14/927,047; dated Mar. 16, 2018, 26 pages.
Snapshot of Office Action for U.S. Appl. No. 15/583,239; dated Mar. 21, 2018, 8 pages.
Snapshot of Office Action for U.S. Appl. No. 14/950,930; dated Mar. 21, 2018, 7 pages.
DIN 4102-1, Fire Behaviour of Building Materials and Elements, Part 1, May 1998, pp. 1-33.
DIN 4102-2, Fire Behaviour of Building Materials and Building Components, Part 2, Sep. 1977, pp. 1-11.
DIN 4102-15, Fire Behaviour of Building Materials and Elements, Part 15, May 1990, pp. 1-15.
DIN 18542, Impregnated Cellular Plastics Strips for Sealing External Joints, Jan. 1999, pp. 1-10.
ASTM International, Standard Test Method for Surface Burning Characteristics of Building Materials, Designation: E-84-04, Feb. 2004, pp. 1-19.
Illbruck Bau-Technik GmbH, Illbruck Illmod 600, Jan. 2002, pp. 1-2.
Illbruck Sealant Systems, Inc., Illbruck Willseal 600, 2001, pp. 1-2.
Iso-Chemie GmbH., Iso-Bloco 600, pp. 1-2, publication date unknown from document.
Iso-Chemie GmbH., Iso-Flame Kombi F 120, pp. 1-2, copyright 2001.
Schul International, Co., LLC., Seismic Sealtite II, Colorized, Pre-compressed Joint Sealant for Vertical Applications, Technical Data, 2006, pp. 1-2.
Underwriters Laboratories, Inc., Standard for Safety, Tests for Fire Resistance of Building Joint Systems, UL-2079, Fourth Edition, Dated Oct. 21, 2004, Revisions through and including Jun. 30, 2008, pp. 1-38.
MM Systems Corp., MM DSS Expansion Joint, Dual Seal Self-Expanding Seismic System, Feb. 18, 2008, pp. 1-2.
Order Granting Request for Ex Parte Reexamination for U.S. Pat. No. 8,739,495, Dec. 12, 2014, Control No. 90/013,395, pp. 1-19.
Emseal Joint Systems, Ltd., Fire-Rating of Emseal 20H System, Feb. 17, 1993, p. 1.
c:\wp\slsmtg\20hdbj.tbl Apr. 18, 1993, 20H—Description, Benefits, Justification, p. 1.
Order Granting Request for Ex Parte Reexamination for U.S. Pat. No. 8,813,449, Feb. 11, 2015, Control No. 90/013,428, pp. 1-19.
Snapshot of Office Action issued in U.S. Appl. No. 90/013,395; printed in 2015, 27 pages.
DIN 4102-16, Fire Behaviour of Building Materials and Elements, Part 16, May 1998, pp. 1-12.
Snapshot of Advisory Action for U.S. Appl. No. 90/013,565; dated Jul. 19, 2016, 5 pages.
Mercury et al., "On the Decomposition of Synthetic Gibbsite Studied by Neutron Thermodiffractometry", J. Am. Ceram, Soc. 89, (2006), pp. 3728-3733.
Brydon et al., "The Nature of Aluminum Hydroxide-Montmorillonite Complexes", The American Minerologist, vol. 51, May-Jun. 1966, pp. 875-889.
Huber, Alumina Trihydrate (ATH), A Versatile Pigment for Coatings, Inks, Adhesives, Caulks and Sealants Applications, Dec. 2005, 5 pgs.
3.3.3.8 Thermal Stability/Loss on Ignition/Endotheric Heat, Figure 3.9, 1 pg.
2000 Fire Resistance Directory, p. 1012; publication date unknown from document.
Firestop Submittal Package, Fire Resistive Joint Systems—Waterproofing, SpecSeal Firestop Products, Specified Technologies, Inc, Somerville NJ; p. 1-37, publication date unknown from document.
Specified Technologies Inc., Product Data Sheet, Series ES, Elastomeric Sealant, Copyright 2000, p. 1-4.
Specified Technologies Inc., Product Data Sheet, PEN200 Silicone Foam, Copyright 2003, p. 1-2.
ISO-Chemie GmbH, Schul International Co., Order Confirmation, Doc. No. 135652, Customer No. 38012, Date, Apr. 26, 2007, p. 1-3.
Watson Bowman ACME, Wabo Seismic Parking Deck Exp. Joints, Sales Drawing, Feb. 6, 1988, 3 pgs.
Emseal Corp., Horizontal Colorseal Data Sheet, Jun. 1997, 3 pgs.
Emseal Corp., Horizontal Colorseal Beneath Coverplate Product Design Drawing, Oct. 2000, 1 pg.
Emseal Corp., 20H System Data Sheet, Sep. 1996, pp. 1-2.
Watson Bowman Acme, Product Catalog, Feb. 1993, pp. 1-8.
Emseal Joint Systems, Watertight by Design, Buyline 0339, Copyrighted 1996 and marked Jan. 1999, 8 pgs.
Dow Corning, Dow Coming 790 Silicone Building Sealant Data Sheet, Copyrighted 1995, 1999, 6 pgs.
Emseal Joint Systems, Sealing Joints in the Building Envelope: Principles, Products & Practices, Copyright date of 1999, 39 pgs.
Emseal Joint Systems, Product Catalog, Copyright date of 1987, 16 pgs.

(56) References Cited

OTHER PUBLICATIONS

Emseal Joint Systems, 20H-Compression Seal Comparison, Apr. 12, 1994, 1 pg.
Emseal Joint Systems, Ltd., Emseal Joint Systems, Marketing Brochure, Jan. 1997, 8 pgs.
City of San Diego, CWP Guidelines, Feb. 1992, pp. 1-13.
Defendants' Joint Second Amended Preliminary Invalidity Contentions received at MKG Jun. 30, 2015, Appendix A, 7 pgs.
Defendants' Joint Second Amended Preliminary Invalidity Contentions received at MKG Jun. 30, 2015, Appendix B-1, 346 pgs.
Defendants' Joint Second Amended Preliminary Invalidity Contentions received at MKG Jun. 30, 2015, Appendix B-2, 314 pgs.
Defendants' Joint Second Amended Preliminary Invalidity Contentions received at MKG Jun. 30, 2015, Appendix C, 159 pgs.
Defendants' Joint Second Amended Preliminary Invalidity Contentions received at MKG Jun. 30, 2015, Appendix D, 5 pgs.
Defendants' Joint Second Amended Preliminary Invalidity Contentions received at MKG Jun. 30, 2015, 1:14-cv-00358-SM, 27 pgs. total.
Snapshot of Office Action for U.S. Appl. No. 90/013,428; dated May 6, 2016, 22 pages.
Snapshot of Office Action for U.S. Appl. No. 14/950,923; dated May 6, 2016, 13 pages.
Snapshot of Office Action for U.S. Appl. No. 14/730,896; dated May 9, 2016, 18 pages.
Snapshot of Office Action for U.S. Appl. No. 14/229,463; dated May 12, 2016, 14 pages.
Snapshot of Advisory Action for U.S. Appl. No. 90/013,511; dated May 9, 2016, 12 pages.
Snapshot of Ex Parte Reexamination Certificate No. U.S. Pat. No. 6,532,708C2 for U.S. Appl. No. 90/013,683; Jun. 7, 2016, 2 pages.
Snapshot of Office Action for U.S. Appl. No. 14/278,210; dated May 19, 2016, 12 pages.
Snapshot of Office Action for U.S. Appl. No. 14/511,394; dated May 13, 2016, 6 pages.
Snapshot of Advisory Action for U.S. Appl. No. 90/013,395; dated May 20, 2016, 4 pages.
Snapshot of Office Action for U.S. Appl. No. 90/013,395; dated Apr. 7, 2016, 37 pages.
Snapshot of Office Action for U.S. Appl. No. 90/013,565; dated Apr. 8, 2016, 48 pages.
Emseal Joint Systems, Ltd., BEJS System Tech Data, Mar. 2009, 2 pages.
Emseal's new Universal-90 expansion joints, Buildingtalk, Pro-Talk Ltd., Mar. 27, 2009, 2 pages.
Emseal Joint Systems, Ltd., Emseal Emshield DFR2 System DFR3 System Tech Data, May 2010, 4 pages.
Emseal Seismic Colorseal, Aug. 21, 2007, 4 pages.
Emseal Joint Systems, Ltd., Emseal New Universal 90's Watertight, Factory Fabricated Upturn/Downturn Transition Pieces for Ensuring Continuity of Seal, Aug. 4, 2009, 4 pages.
Notification of Transmittal of International Preliminary Report on Patentability in PCT/US14/32212; dated Mar. 13, 2015; 4 pages.
Snapshot of Office Actions issued in U.S. Appl. No. 13/729,500); printed in 2015; 35 pages.
Snapshot of Office Actions issued in U.S. Appl. No. 14/278,210; printed in 2015; 27 pages.
Snapshot of Office Actions issued in U.S. Appl. No. 12/635,0621; printed in 2015; 88 pages.
Snapshot of Office Actions issued in U.S. Appl. No. 13/731,327; printed in 2015; 42 pages.
Snapshot of Office Action issued in U.S. Appl. No. 14/455,398; printed in 2015; 9 pages.
Snapshot of Office Actions issued in U.S. Appl. No. 13/652,021; printed in 2015; 34 pages.
Snapshot of Office Actions issued in U.S. Appl. No. 14/080,960; printed in 2015; 10 pages.
Snapshot of Office Actions issued in U.S. Appl. No. 14/084,930; printed in 2015; 7 pages.
Snapshot of Office Action issued in U.S. Appl. No. 14/229,463; printed in 2015; 20 pages.
Snapshot of Office Action issued in U.S. Appl. No. 14/455,403; printed in 2015; 12 pages.
Snapshot of Office Action issued in U.S. Appl. No. 14/211,694; printed in 2015; 6 pages.
List of several Emseal pending patent applications and patents, and Examiners assigned thereto; Apr. 2015; 2 pages.
Snapshot of Advisory Action for U.S. Appl. No. 90/013,472-U.S. Appl. No. 90/013,473; dated Dec. 28, 2015,13 pages.
Snapshot of Non-Final Office Action for U.S. Appl. No. 90/013,428; dated Jan. 5, 2016, 14 pages.
Snapshot of Non-Final Office Action for U.S. Appl. No. 90/013,565; dated Jan. 8, 2016, 20 pages.
Snapshot of Ex Parte Reexamination Certificate for U.S. Appl. No. 90/013,428; Nov. 23, 2016, 3 pages.
Snapshot of Notice of Allowance for U.S. Appl. No. 14/540,514; dated Nov. 25, 2016, 4 pages.
Snapshot of Office Action for U.S. Appl. No. 14/278,210; dated Nov. 30, 2016, 12 pages.
Snapshot of Examinees Interview Summary for U.S. Appl. No. 90/013,511; dated Aug. 26, 2016, 9 pages.
Emseal, BEJS System—Bridge Expansion Joint System, May 26, 2010, 5 pages
Emseal, Emseal Acrylic Log Home Tape Installation Instructions, Jun. 2011, 1 page.
Snapshot of Notice of Allowance for U.S. Appl. No. 13/652,021; dated Jan. 8, 2016, 7 pages.
Snapshot of Non-Final Office Action for U.S. Appl. No. 14/084,930; dated Jan. 12, 2016, 11 pages.
Snapshot of Office Action in Ex Parte Reexamination for U.S. Appl. No. 90/013,395; Jan. 20, 2016, 26 pages.
Snapshot of Final Office Action for U.S. Appl. No. 14/540,514; dated Mar. 31, 2016, 18 pages.
Emseal Corporation, Seismic Colorseal by Emseal, "Last Modified": Aug. 21, 2007, 4 pages.
Emseal Joint Systems, Ltd., Backerseal (Greyflex), Sep. 2001, 2 pages.
Emseal Joint Systems, Ltd., Install Data—Horizontal Colorseal—With Expoxy Adhesive, Jun. 2006, 2 pages.
Schul International Co., LLC., Sealtite VP (600) Technical Data, Premium Quality Pre-compressed Joint Sealant for Weather tight, Vapor Permeable, Vertical Applications, labeled Copyright 1997-2002, pp. 1-2.
Schul International Co., LLC., Seismic Sealtite, Technical Data, Colorized, Pre-compressed Joint Sealant for Vertical Applications, 2005, pp. 1-2.
Schul International Co., LLC., Sealtite 50N, Technical Data, Premium Quality Pre-compressed Joint Sealant for Horizontal Applications, labeled Copyright 2002, pp. 1-2.
Schul International Co., LLC., HydroStop, Expansion Joint System, 2005, pp. 1-2.
Schul International Co., LL., Sealtite, the Most Complete Line of Pre-compressed Sealants, web archive.org, wayback machine, printed 2014, pp. 1-3.
Sealant, Waterproofing & Restoration Institute, Sealants: The Professional Guide, labeled Copyright 1995, Chapter II—Sealants, p. 26, pp. 1-3.
Tremco Illbruck, Cocoband 6069, 2007, p. 1 with English translation.
Tremco Illbruck, Alfacryl FR Intumescent Acrylic, Fire Rated, Emulsion Acrylic, Intumescent Sealant, 2007, pp. 1-2.
Tremco Illbruck, Alfasil FR, Fire Rated, Low Modulus, Neutral Cure Silicone Sealant, 2007, pp. 1-2.
Tremco Illbruck, Compriband 600, Impregnated Joint Sealing Tape, 2007, pp. 1-2.
Tremco Illbruck, Compriband Super FR, Fire Rated Acrylic Impregnated Foam Sealant Strip, 2007, pp. 1-2.
Tremco Illbruck, Ltd., Technical Data Sheet, Compriband Super FR, Issue 2, Oct. 18, 2004, pp. 1-4.
Tremco Illbruck, Ltd., Technical Data Sheet, Compriband Super, Issue 1, Sep. 29, 2004, pp. 1-3.

(56) References Cited

OTHER PUBLICATIONS

Illbruck, TechSpec Division Facade & Roofing Solutions, Mar. 2005, pp. 1-10.
Tremco Illbruck, Alfas Bond FR, 2007, pp. 1-2.
Tremco Illbruck, Illmod 600, Jun. 2006, pp. 1-2.
Tremco Illbruck, the Specification Product Range, 2007, pp. 1-36.
Tremco Illbruck, Webbflex B1 PU Foam, Fire Rated Expanding Polyurethane Foam, Sep. 11, 2006, pp. 1-2.
UL Online Certifications Directory, System No. WW-S-0007, XHBN. WW-S-0007, Joint Systems, Dec. 5, 1997, pp. 1-3.
UL Online Certifications Directory, BXUV.GuideInfo, Fire-Resistance Ratings ANSI/UL 263, last updated Jun. 26, 2014, pp. 1-24.
Frangi et al., German language, Zum Brandverhalten von Holzdecken aus Hohlkasten-elementen, Institut fur Baustatik and Konstrucktion, Jun. 1999, pp. 1-130.
ASTM International, Designation: E 1966-01, Standard Test Method for Fire-Resistive Joint Systems, current edition approved Oct. 10, 2001. Published Jan. 2002, pp. 1-15.
www.businesswire.com, Celanese Introduces Mowilith Nano Technology Platform for the Next General of Exterior Coatings, Nurnberg, Germany, May 8, 2007, pp. 1-3.
Illbruck, Willseal firestop applied in the joints of the new Pfalz Theater in Kaiserlautern, pp. 1-2; publication date unknown document.
Dayton Superior Chemical & Cement Products, Marketing Update, Fall 2005, pp. 1-2.
Dow Coming Case Study EU Parliament, Brussels, p. 1; publication date unknown from document.
Dow Coming Silicone Sealants, Dow Coming 790 Silicone Building Sealant, Ultra-low-modulus sealant for new and remedial construction joint sealing applications, labeled Copyright 2000-2005, pp. 1-2.
Dow Coming, John D. Farrell Letter to Emseal USA, Wilford Brewer, reference: Emseal Greyflex, Oct. 4, 1984, p. 1.
Dow Coming letter to Customer, Reference: Sealant Certification for Dow Coming 790 Silicone Building Sealant, p. 1; publication date unknown from document.
Emseal Joint Systems, Ltd., Greyflex & Backerseal Wet Sealant Compatibility Chart, Test Data, Sep. 1991, p. 1.
Emseal Joint Systems, Emseal preformed expanding foam sealant, 07920/MAN, pp. 1-2; publication date unknown from document.
Colorseal by Emseal Specification Sections 07 90 00/ 07 95 00, pp. 1-4, publication date unknown from document.
Emseal Joint Systems, Ltd., Emseal Color-seal, Tech Data, pp. 1-2, publication date unknown from document.
Emseal Joint Systems, Ltd., Emseal Color-Seal, p. 1, publication date unknown from document.
www.emseal.com/products, Horizontal Colorseal by Emseal Expansion Joints and Pre-Compressed Sealants, last modified Sep. 19, 2014.
Horizontal Colorseal by Emseal, Specification Sections 07 90 00/ 07 95 00, pp. 1-4; publication date unknown document.
Emseal Material Safety Data Sheet, Acrylic Loghome Tape, pp. 1-2, issued Apr. 2002.
Seismic Colorseal by Emseal Specification Sections 07 90 00/ 07 95 00, pp. 1-4; publication date unknown from document.
Emseal Joint Systems, Ltd., Summary Guide Specification, p. 1; publication date unknown from document.
Emseal Joint Systems, the complete package for all joint requirements, 1988, pp. 1-6.
Envirograf, Cavity Barriers Fire Seal Range, Technical Data, pp. 1-32; publication date from unknown from document.
web.archive.org, www.envirogratcom, Product 40: Intumescent-Coated Fireproof Sponge (patented), labeled copyright 2007, pp. 1-2.
web.archive.org, www.envirogratcom, Product 5: Intumescent-Coated Non-Fibrous Slabs (patented), labeled Copyright Apr. 10, 2007, p. 1.
Afk Yapi Elemanlari, Hannoband-BSB BG1, Fire prevention tape Flame resistand pursuant to DIN 4102 T1, Technical Data Sheet, pp. 1-4; publication date unknown document.
Hanno Dicht-und Dammsysteme, Hannoband-BG1, High Performance am Bau, German language, 2000, pp. 1-6.
Illbruck, willseal firestop fur die Brandschutz-Fuge, Information,German language, pp. 1-2; publication date unknown from document.
Illbruck Sealant Systems, Cocoband 6069, Productinfomatie, Dutch language, 2003, pp. 1-2.
Illbruck Sealant Systems, Inc., Sealant Products and Systems, 2002, pp. 1-12.
Illbruck, Will-Seal, 3.0 Construction Requirements, pp. 1-8; publication date unknown from document.
Sealtite Joint Sealants, What is the material used in the U-Channel? pp. 1-4; publication date unknown from document.
Snapshot of Notice of Allowance for U.S. Appl. No. 14/950,930; dated Apr. 25, 2018, 10 pages.
Snapshot of Notice of Allowance for U.S. Appl. No. 14/950,923; dated May 7, 2018, 10 pages.
Snapshot of Office Action for U.S. Appl. No. 15/494,069; dated Jul. 6, 2018, 14 pages.
Snapshot of Office Action for U.S. Appl. No. 15/494,809; dated Jul. 6, 2018, 6 pages.
Snapshot of Final Office Action for U.S. Appl. No. 90/013,511; dated Feb. 26, 2016, 45 pages.
Snapshot of Office Action for U.S. Appl. No. 14/950,923; dated Jan. 10, 2018, 7 pages.
Snapshot of Notice of Allowability for U.S. Appl. No. 14/730,896; dated Jan. 16, 2018, 3 pages.
Underwriters Laboratories Inc., System WW-D0001, Fire Resistance Directory, vol. 2, Copyright 2000, 3 pages.
Underwriters Laboratories Inc., System FF-D-1010, 2000 Fire Resistance Directory, 2000, 1 page.
Emseal Joint Systems, Ltd., Seismic Colorseal—DS (Double-Sided), 2006, 3 pages.
Emseal Joint Systems, Ltd., BEJS System, Bridge Expansion Joint System, last modified Jul. 29, 2009, 5 pages.
Emseal Joint Systems, Ltd., AST Hi-Acrylic Metal Roof and Multi-Use Building Sealant, 2005, 2 pages.
Emseal Joint Systems, Ltd., BEJS System Install Data, Internet archive dated Sep. 22, 2010, 1 page.
Emseal Joint Systems, Drawing SJS-100 in Recessed Block With Header Material, Jun. 7, 2006, 1 page.
Specified Technologies, Inc., Firestop Products for Construction Joint Applications, Copyright 2004 indicated on last page, 20 pages.
Adolf Wurth GmbH & Co., KG, Elastic Joint Sealing Tape, labeled Copyright 2000-2003, pp. 1-7.
Expanding PU Foam, Technical Data Sheet, Feb. 1997, pp. 1-2.
ASTM International, Designation: E 84-04, Standard Test Method for Surface Burning Characteristics of Building Materials, Feb. 2004, pp. 1-19.
ASTM International, Designation: E 176-07, Standard Terminology of Fire Standards, Oct. 2007, pp. 1-20.
Aubum Manufacturing Company, Auburn Product News, Flame Retardant Silicone Sponge, 2007, p. 1.
British Board of Agrement, Agrement Certificate No. 97/3331, Second Issue, Compriband Super, 2005, pp. 1-4.
British Board of Agrement, Agrement Certificate No. 96/3309, Third Issue, Illmod 600 Sealing Tapes, 2003, pp. 1-8.
Nederland Normalistie-Instituut, Experimental Determination of the Fire Resistance of Elements of Building Construction, NEN 6069, Oct. 1991, English Translation, pp. 1-30.
British Standards Institution, Fire Tests on Building Materials and Structures, BS 476: Part 20: 1987, pp. 1-44.
DIN Deutsches Institut for Normung e.V., DIN 18542, Impregnated Cellular Plastics Strips for Sealing External Joints, Requirements and Testing, Jan. 1999, pp. 1-10.
www.BuildingTalk.com, Emseal Joint Systems, Choosing a Sealant for Building Applications, Hensley. May 21, 2007, pp. 1-6.
Netherlands Organization for Applied Scientific Research (TNO), Determination of the Fire Resistance According to NEN 6069 of Joints in a Wall Sealed with Cocoband 6069 Impregnated Foam Strip, Nov. 1996, pp. 1-19.

(56) References Cited

OTHER PUBLICATIONS

DIN Deutsches Institut fur Normung e.V., Fire Behaviour of Building Materials and Elements, Part 1: Classification of Building Materials, Requirements and Testing, DIN 4102-1, May 1998, pp. 1-33.
DIN Deutsches Institut fur Normung e.V., Fire Behaviour of Building Materials and Elements, Overview and Design of classified Building Materials, Elements and Components, DIN 4102-4, Mar. 1994, pp. 1-144.
DOW Coming Corporation, Dow Coming 790, Silicone Building Sealant, labeled Copyright 2000, pp. 1-6.
DOW Coming Corporation, Dow Coming 790, Silicone Building Sealant, Product Information, labeled Copyright 2000-2004, pp. 1-4.
DOW Coming Corporation, Dow Coming Firestop 400 Acrylic Sealant, 2001, pp. 1-4.
DOW Coming Corporation, Dow Coming Firestop 700 Silicone Sealant, 2001, pp. 1-6.
Emseal Joint Systems, Horizontal Colorseal, Aug. 2000, pp. 1-2.
Emseal Joint Systems, Ltd., Colorseal PC/SA Stick STD/001-0-00-00, 1995, p. 1.
Emseal Joint Systems, Ltd., 20H System, Tech Data, Jun. 1997, pp. 1-2.
Emseal Joint Systems, Ltd., Colorseal, Aug. 2000, pp. 1-2.
Emseal Joint Systems, Ltd., DSH System, Watertight Joint System for Decks, Tech Data, Nov. 2005, pp. 1-2.
Emseal Joint Systems, Ltd., Fire-Rating of Emseal 20H System, Feb. 17, 1993, p. 1-2.
Emseal Joint Systems, Ltd., Preformed Sealants and Expansion Joint Systems, May 2002, pp. 1-4.
Emseal Joint Systems, Ltd., Pre-Formed Sealants and Expansion Joints, Jan. 2002, pp. 1-4.
Emseal Joint Systems, Ltd., Seismic Colorseal, Aug. 2000, pp. 1-2.
Emseal Joint Systems, Ltd., Seismic Colorseal-DS (Double-Sided) Apr. 12, 2007, pp. 1-4.
Environmental Seals, Ltd., Envirograf, Fire Kills: Stop it today with fire stopping products for building gaps and openings, 2004, pp. 1-8.
Fire Retardants, Inc., Fire Barrier CP 25WB+Caulk, labeled Copyright 2002, pp. 1-4.
Illbruck Bau-Produkte GmbH u. CO. KG., willseal firestop, Product Information Joint Sealing Tape for the Fire Protection Joint, Sep. 30, 1995, pp. 1-9.
Illbruck, willseal, The Joint Sealing Tape, 1991, pp. 1-19.
Illbruck, willseal 600, Product Data Sheet, 2001, pp. 1-2.
Material Safety Data Sheet, Wilseal 150/250 and/or E.P.S., Jul. 21, 1986, pp. 1-2.
ISO 066, Technical Datasheet, blocostop F-120, 2002 p. 1.
MM Systems, ejp Expansion Joints, Expanding Impregnated Foam System, intemet archive, wayback machine, Nov. 16, 2007, pp. 1-2.
MM Systems, ejp Expansion Joints, Colorjoint/SIF—Silicone Impregnated Foam System, intemet archive, wayback machine, Nov. 16, 2007, pp. 1-2.
MM Systems, ColorJoint/SIF Series, Silicone Seal & Impregnated Expanding Foam, Spec Data, 2007, pp. 1-3.
Norton Performance Plastics Corporation, Norseal V740FR, Flame Retardant, UL Recognized Multi-Purpose Foam Sealant, labeled Copyright 1996, pp. 1-2.
Promat Intemational,Ltd., Promaseal FyreStrip, Seals for Movement Joints in Floors/Walls, labeled Copyright 2006, pp. 1-4.
Promat International, Ltd., Promaseal Guide for Linear Gap Seals and Fire Stopping Systems, Jun. 2008, pp. 1-20.
Promat International, Ltd., Promaseal IBS Foam Strip, Penetration Seals on Floors/Walls, labeled Copyright 2004, pp. 1-6.
Promat International, Ltd., Safety Data Sheet, Promaseal IBS, May 25, 2007, pp. 1-3.
Schul International, Co., LLC., Color Econoseal, Technical Data, Premium Quailty Joint Sealant for Waterproof Vertical and Horizontal Applications, 2005, pp. 1-2.
Schul International, Co., LLC., Sealtite Airstop FR, Air and Sound Infiltration Barrier, labeled Copyright 1997-04, p. 1.
Schul International, Co., LLC., Sealtite Standard, Pre-compressed Joint Sealant, High Density, Polyurethane Foam, Waterproofs Vertical Applications, 2007.
Snapshot of Office Action for U.S. Appl. No. 14/950,930; dated Jun. 16, 2017, 6 pages.
Illbruck Construction Products, "Worldwide solutions to joint-sealing and acoustic problems", Apr. 9, 1998, 77 pages, Illbruck Construction Products, Wrexham, United Kingdom.
Snapshot of Office Action for U.S. Appl. No. 16/115,858; dated Mar. 15, 2019, 7 pages.
Snapshot of Notice of Allowance for U.S. Appl. No. 16/115,861; dated May 15, 2019, 5 pages.
Snapshot of Office Action for U.S. Appl. No. 15/633,196; dated Apr. 30, 2019, 17 pages.
Snapshot of Office Action for U.S. Appl. No. 15/386,907; dated May 13, 2019, 8 pages.
Snapshot of Office Action for U.S. Appl. No. 15/386,907; dated Nov. 1, 2018, 8 pages.
Snapshot of Office Action for U.S. Appl. No. 15/589,329; dated Nov. 1, 2018, 13 pages.
Snapshot of Office Action for U.S. Appl. No. 15/633,196; dated Nov. 1, 2018, 17 pages.
Snapshot of Office Action for U.S. Appl. No. 15/633,176; dated Nov. 1, 2018, 15 pages.
Snapshot of Office Action for U.S. Appl. No. 14/927,047; dated Nov. 13, 2018, 32 pages.
Snapshot of Office Action for U.S. Appl. No. 15/1589,329; dated Apr. 4, 2019, 11 pages.
Snapshot of Office Action for U.S. Appl. No. 15/633,176; dated Apr. 8, 2019, 15 pages.
Snapshot of Office Action for U.S. Appl. No. 15/613,936; dated Jun. 26, 2019, 28 pages.
Snapshot of Office Action for U.S. Appl. No. 16/243,250; dated Jun. 27, 2019, 25 pages.
Snapshot of Office Action for U.S. Appl. No. 15/589,329; dated Jul. 25, 2019, 9 pages.
Snapshot of Office Action for U.S. Appl. No. 15/633,176; dated Jul. 29, 2019, 12 pages.
Snapshot of Office Action for U.S. Appl. No. 16/115,858; dated Jul. 30, 2019, 7 pages.
Snapshot of Office Action for U.S. Appl. No. 15/633,196; dated Aug. 15, 2019, 13 pages.
Snapshot of Office Action for U.S. Appl. No. 15/589,329; dated Nov. 20, 2019, 10 pages.
Snapshot of Office Action for U.S. Appl. No. 15/613,936; dated Nov. 21, 2019, 23 pages.
Snapshot of Office Action for U.S. Appl. No. 15/633,176; dated Nov. 21, 2019, 13 pages.
Snapshot of Office Action for U.S. Appl. No. 16/243,250; dated Jan. 2, 2020, 22 pages.
Snapshot of Office Action for U.S. Appl. No. 15/633,196; dated Jan. 2, 2020, 13 pages.
Snapshot of Office Action for U.S. Appl. No. 15/613,936; dated Jan. 29, 2020, 4 pages.
Snapshot of Office Action for U.S. Appl. No. 15/589,329; dated Jan. 29, 2020, 3 pages.
Snapshot of Office Action for U.S. Appl. No. 15/633,176; dated Jan. 29, 2020, 4 pages.
Snapshot of Office Action for U.S. Appl. No. 15/494,809; dated Dec. 11, 2018, 11 pages.
Snapshot of Office Action for U.S. Appl. No. 15/613,936; dated Jan. 24, 2019, 7 pages.
Snapshot of Office Action for U.S. Appl. No. 16/115,861; dated Jan. 24, 2019, 5 pages.
Notice of Allowance for U.S. Appl. No. 14/927,047; dated Feb. 6, 2019, 8 pages.
System No. WW-D-0001, 2000N Fire Resistance Directory,p. 1149, 2000, Underwriters Laboratories, Inc., USA.†
81 Elastic Joint Sealing Tape, 4 pages, Aug. 5, 2005, Adolf Wurth GmbH & Co., KG\.†
UL 2079 Tests for Fire Resistance of Building Joint Systems, 38 pages, Jun. 30, 2008, Underwriters Laboratories Inc., Northbrook, Illinois.†

(56) References Cited

OTHER PUBLICATIONS

Pensil PEN300 Silicone Sealant, 4 pages, Specified Technologies, Inc., USA.†
System No. FF-D-1010, 2000 Fire Resistance Directory, p. 1018, 2000, Underwriters Laboratories, Inc., USA.†
Sealtite B Technical Data; Oct. 28, 2005; 2 pages, Schul International Co., LLC;USA.†

* cited by examiner
† cited by third party

FIG. 16
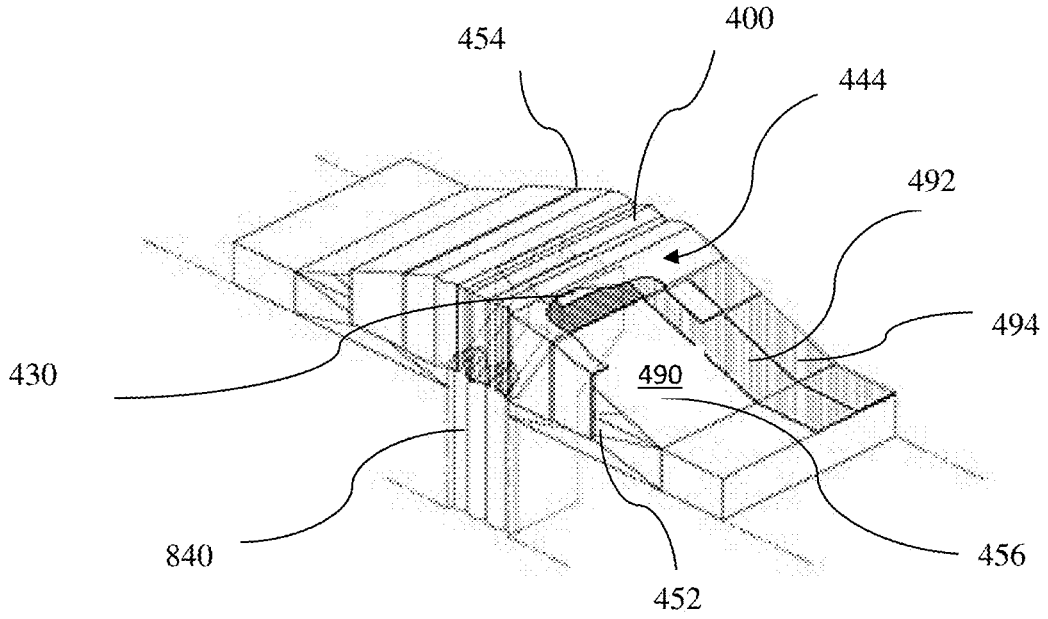
FIG. 16A
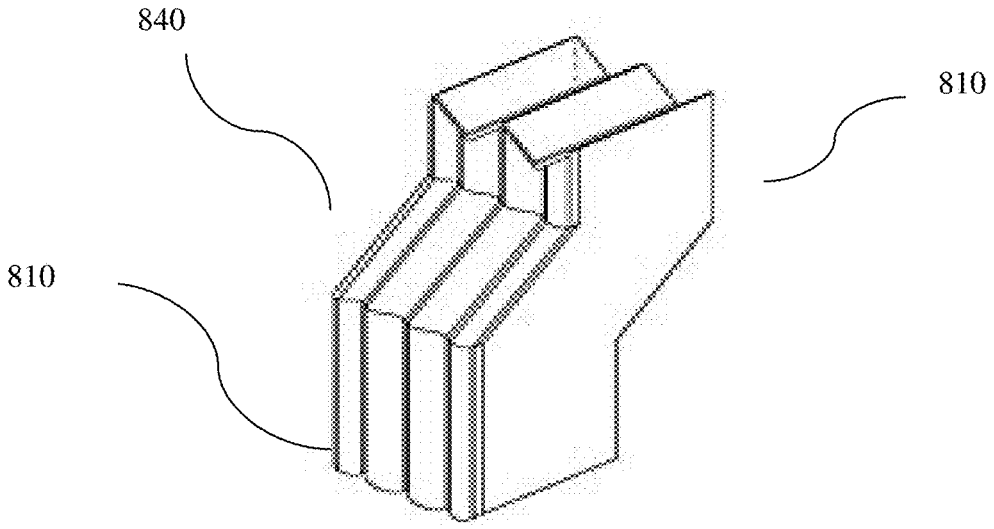
FIG. 16B

FIG. 17
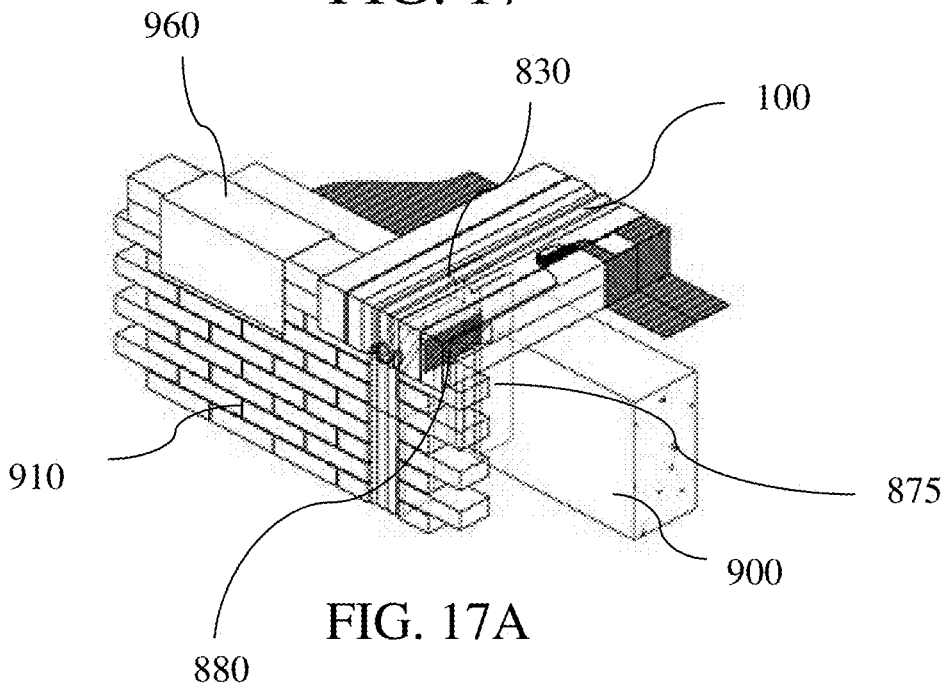
FIG. 17A
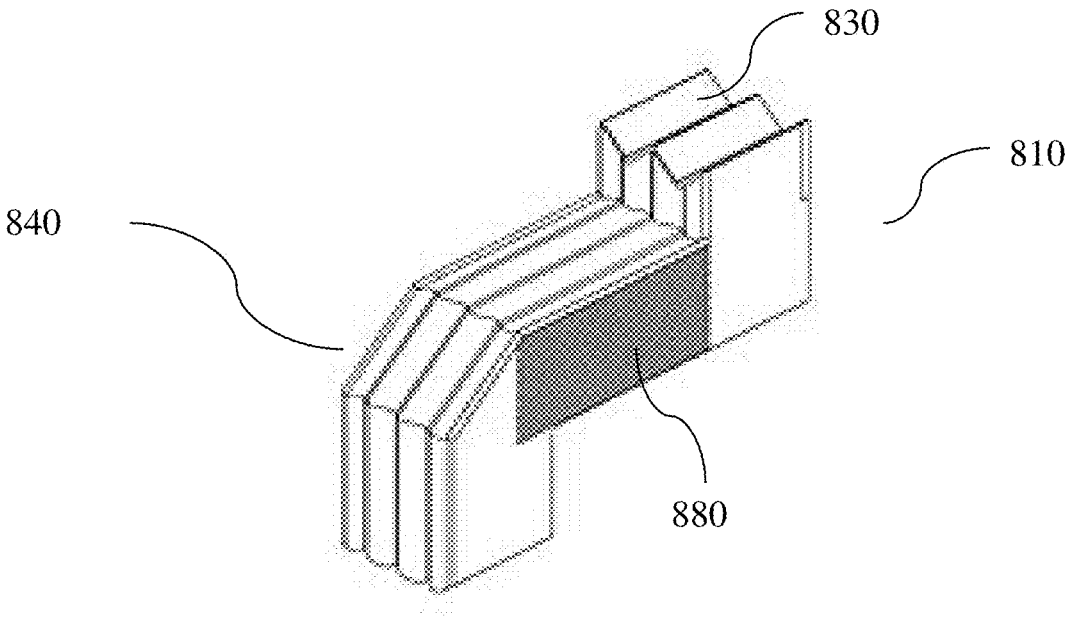
FIG. 17B

FIRE AND WATER RESISTANT, INTEGRATED WALL AND ROOF EXPANSION JOINT SEAL SYSTEM

CROSS-REFERENCE TO RELATED APPLICATIONS

The present application is a Continuation-in-Part Application of U.S. patent application Ser. No. 14/211,694, filed on Mar. 14, 2014, now U.S. Pat. No. which claims the benefit of U.S. Provisional Patent Application Ser. No. 61/788,866, filed Mar. 15, 2013 and is a Continuation-in-Part Application of U.S. Non-Provisional patent application Ser. No 13/652,021 filed Oct. 15, 2012, now U.S. Pat. No. 9,322,163, which claims the benefit of U.S. Provisional Patent Application Ser. No. 61/547,476, filed Oct. 14, 2011, entitled "THERMOPLASTIC EXPANSION JOINT SEAL FOR ROOFS." The present application is also a Continuation-in-Part Application of U.S. patent application Ser. No. 15/613,936, filed on Jun. 5, 2017, which is a Continuation Application of Ser. No. 13/729,500, filed on Dec. 28, 2012, now U.S. Pat. No. 9,670,666, which is a Continuation-in-part Application of U.S. Non-Provisional patent application Ser. No. 12/622,574, filed on Nov. 20, 2009, now U.S. Pat. No. 8,365,495, which claims the benefit of U.S. Provisional Patent Application Ser. No. 61/116,453, filed Nov. 20, 2008. The contents of all of the foregoing applications are hereby incorporated by reference in their entireties.

FIELD OF THE INVENTION

The present invention is generally directed to joint sealing systems, and more particularly, to systems for sealing structural expansion joint openings in roofs of structures.

BACKGROUND OF THE INVENTION

In many construction projects involving materials such as concrete and steel, gaps are left between adjacent structural elements to allow for thermal expansion and contraction, wind sway, settlement, live load deflection, and/or seismic movements of the structural elements. By permitting expansion and contraction, the gaps prevent the structural materials and/or building cladding elements from cracking or buckling. These gaps are referred to as expansion joints or movement joints and are typically sealed to prevent them from allowing the passage of water, dirt, debris, or snow, etc. into the structure and/or between portions of the structure.

Current systems for sealing exterior expansion joints in the roofs of structures typically consist of a length of flexible material or membrane that spans a length and width of the joint between adjacent elements and is attached to each side of the joint by anchor bars that are screwed or bolted to the substrate. The membrane, usually a sheet of rubber or the like, is wider than the joint itself to seal the joint and to allow for movement of the structural materials with the joint. Two designs have been developed to address the issue of debris collecting on top of the membrane and straining the seal. FIG. 1 shows a prior art example of a roof expansion joint seal 10 manufactured by Johns Manville (Denver, Colo. USA). In this design, a membrane 12 is humped up above a joint J by a foam backing 14 to seal S the joint J. FIG. 2 shows a prior art example of a roof expansion joint seal 20 manufactured by MM Systems Corporation (Pendergrass, Ga. USA). This design includes a metal cover 24 over a membrane 22, which is allowed to hang into the joint J to form the seal S. As shown in FIG. 1, the roof expansion joint seal 10 is affixed about the joint J by one or more fasteners 16 through a flange 18 of the roof expansion joint seal 10. Similarly, as shown in FIG. 2, the roof expansion joint seal 20 is affixed about the joint J by fasteners 26 through a lip or flange 28 of the roof joint seal 20.

Problems may arise with either joint seal 10 and 20 in several areas. For example, the fasteners 16 and 26 are exposed to weather conditions and the seals may fail as they deteriorate and no longer effectively anchor the seals 10 and 20 about the joint J. Additionally, the seals 10 and 20 provide only a single layer of waterproofing, increasing the chances of failure of the seals. Finally, the shape of the membrane 12 and 22, whether hanging down or humped up, makes it difficult to transition from a horizontal roof expansion joint to a vertical wall expansion joint without compromising the continuity of the seals or undertaking significant modifications to the seals 10 and 20 in the field.

SUMMARY OF THE INVENTION

According to aspects illustrated herein, there is provided a watertight, integrated wall and roof expansion joint seal system comprising an expansion joint seal for a structure. The expansion joint seal comprises a central portion having an underside and at least one central chamber disposed around a centerline. The central portion is disposed within and fills a gap between a first substrate and a second substrate of a structure of interest such a roof. The expansion joint seal has a first flange portion extending outwardly from the centerline and a second flange portion extending outwardly from the centerline in a direction opposite the first flange portion. The expansion joint seal also comprises a fold comprising a first fold portion and a second fold portion. The first fold portion of the first flange portion is attachable to a first surface of the first substrate and the second fold portion of the first flange portion is attachable to a second surface of the first substrate. The first fold portion of the second flange portion is attachable to a first surface of the second substrate and the second fold portion of the second flange portion is attachable to a second surface of the second substrate. The watertight integrated wall and roof expansion joint seal system also comprises a joint closure comprising a core and a layer of elastomer disposed on the core. The joint closure also comprises an end portion configured to match and integrate with the underside of the central portion to form the watertight, integrated wall and roof expansion joint system, wherein movement of one or both of the first or second substrates causes a response in the central portion to maintain the seal. In one embodiment, at least one of the first flange portion and the second flange portion is comprised of a flexible material such that the at least one of the first flange portion and the second flange portion may be affixed to the structure at an angle or an elevation that differs from the central portion. In one embodiment, at least one of the first flange portion and the second flange portion is bifurcated into an upper flange portion and a lower flange portion. The upper flange portion extends further in length from the centerline than the lower flange portion to facilitate interlaying the expansion joint seal with roofing materials to form a water tight seal of the structure.

According to embodiments, the expansion joint seal system further comprises a watertight barrier located beneath the central portion and between the first substrate and the second substrate forming a watertight seal between the first substrate and the second substrate. Movement of one or more of the first substrate and the second substrate causes a response in the central portion and in the watertight barrier to maintain the seal. According to further embodiments, the expansion joint seal system comprises an insulation batt and a looped membrane of roofing material located beneath the central portion and between the first substrate and the second substrate forming an insulating seal between the first substrate and the second substrate, wherein movement of one or more of the first substrate and the second substrate causes a response in the central portion to maintain the seal.

According to further aspects illustrated herein, there is provided a garden roof assembly. The garden roof assembly comprises an expansion joint seal for a structure, comprising a central portion having at least one central chamber disposed around a centerline; a first flange portion extending outwardly from the centerline; and a second flange portion extending outwardly from the centerline in a direction opposite the first flange portion. The expansion joint seal also comprises a fold comprising a first fold portion and a second fold portion. The first fold portion of the first flange portion is attachable to a first surface of the first substrate and the second fold portion of the first flange portion is attachable to a second surface of the first substrate. The first fold portion of the second flange portion is attachable to a first surface of the second substrate and the second fold portion of the second flange portion is attachable to a second surface of the second substrate, the expansion joint seal being configured for a roof. The garden roof assembly further comprises at least one layer of roofing material located over the expansion joint seal and comprising a growing medium, thereby forming the garden roof assembly.

According to further aspects illustrated herein, there is provided an expansion joint seal system comprising an expansion joint seal for a structure. The seal comprises a central portion having at least one central chamber disposed around a centerline; a first flange portion extending outwardly from the centerline; and a second flange portion extending outwardly from the centerline in a direction opposite the first flange portion. When installed on the structure the first flange portion is attachable to a first substrate of the structure and the second flange portion is attachable to a second substrate of the structure such that the central portion is disposed within and seals a gap formed between the first substrate and the second substrate of the structure; wherein movement of one or both of the first substrate and the second substrate causes a response in the central portion to maintain the seal. The expansion joint seal system further comprises at least one of i) a watertight barrier located beneath the central portion and between the first substrate and the second substrate forming a watertight seal between the first substrate and the second substrate, and ii) an insulation batt and a looped membrane of roofing material located beneath the central portion and between the first substrate and the second substrate forming an insulating seal between the first substrate and the second substrate.

According to further aspects illustrated herein, there is provided a garden roof assembly comprising an expansion joint seal for a structure. The expansion joint seal comprises a central portion having at least one central chamber disposed around a centerline; a first flange a first flange portion extending outwardly from the centerline; and a second flange portion extending outwardly from the centerline in a direction opposite the first flange portion. When installed on the structure the first flange portion is attachable to a first substrate of the structure and the second flange portion is attachable to a second substrate of the structure such that the central portion is disposed within and seals a gap formed between the first substrate and the second substrate of the structure. Movement of one or both of the first substrate and the second substrate causes a response in the central portion to maintain the seal. The garden roof assembly further comprises at least one layer of roofing material located over the expansion joint seal and comprising a growing medium, thereby forming the garden roof assembly.

BRIEF DESCRIPTION OF THE DRAWINGS

FIG. 16 is a perspective view of the expansion joint seal system of FIG. 11 as installed in a solid to wall roof closure application (shown in FIG. 16A) and employing a joint closure configured as a solid to wall transition piece (shown in FIG. 16B);

FIG. 17 is a perspective view of the expansion joint seal system of FIG. 11 as installed in a cavity to wall roof closure application (shown in FIG. 17A) and employing a joint closure configured as a cavity to wall transition piece (shown in FIG. 17B);

DETAILED DESCRIPTION OF PREFERRED EMBODIMENTS

The present invention alleviates perceived problems associated with current rooftop expansion joint systems by including, for example, redundant levels of waterproofing, a dual flange apparatus, which protects the anchors and enhances the seal, and the ability to manufacture transitions that can be integrated into coplanar, perpendicular and other expansion joints.

Figure 1:
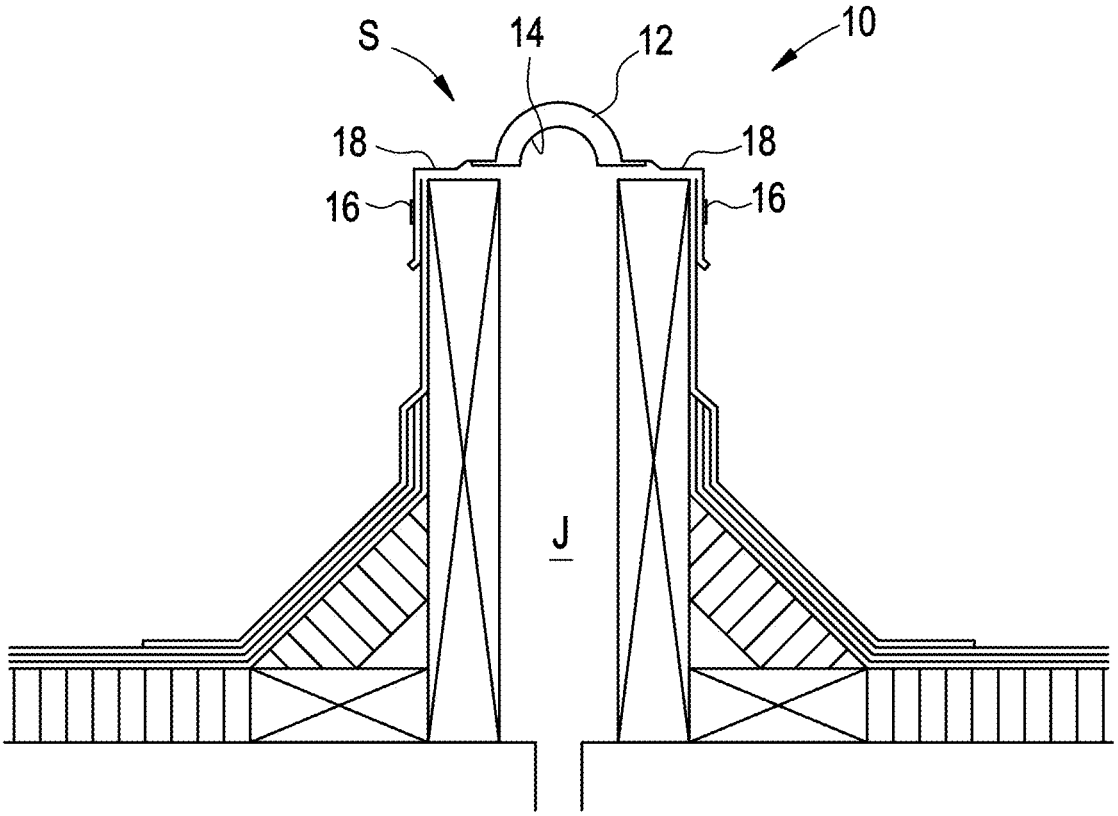
FIG. 1 PRIOR ART
FIG. 1 is a cross-sectional view of a prior art roof expansion joint seal.
Figure 2:
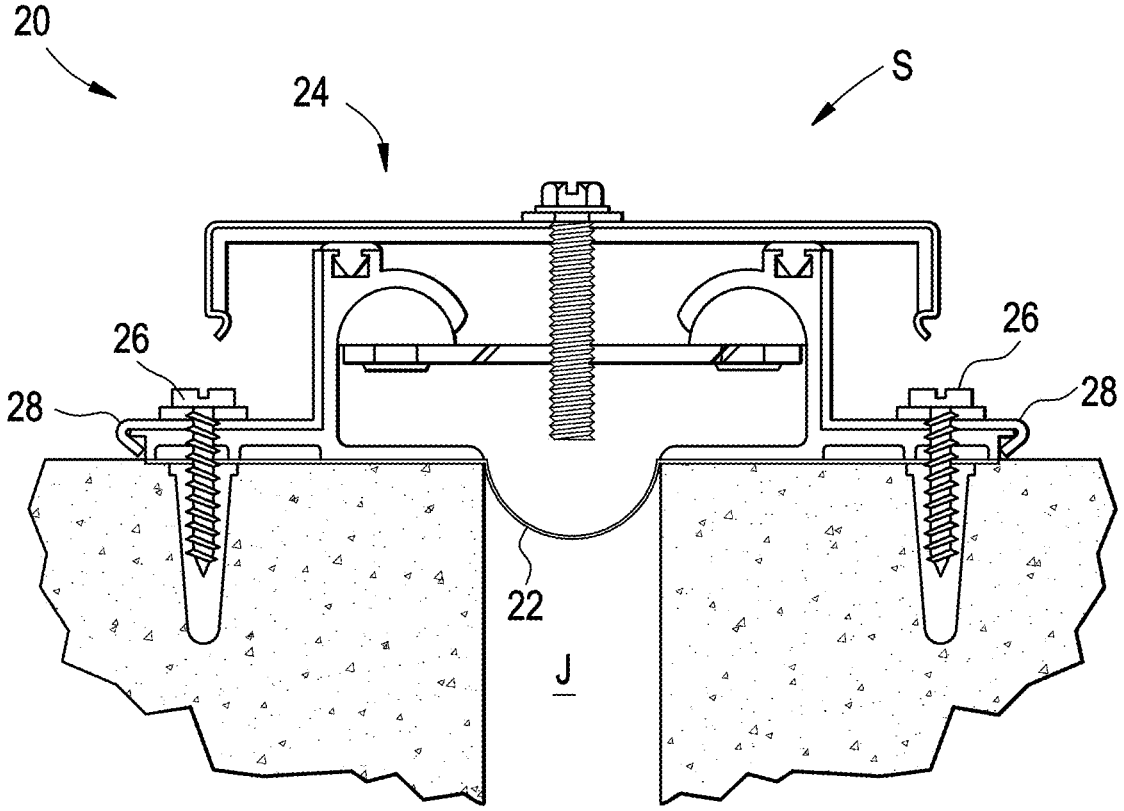
FIG. 2 PRIOR ART
FIG. 2 is a cross-sectional view of a prior art roof expansion joint seal.
Figure 3:
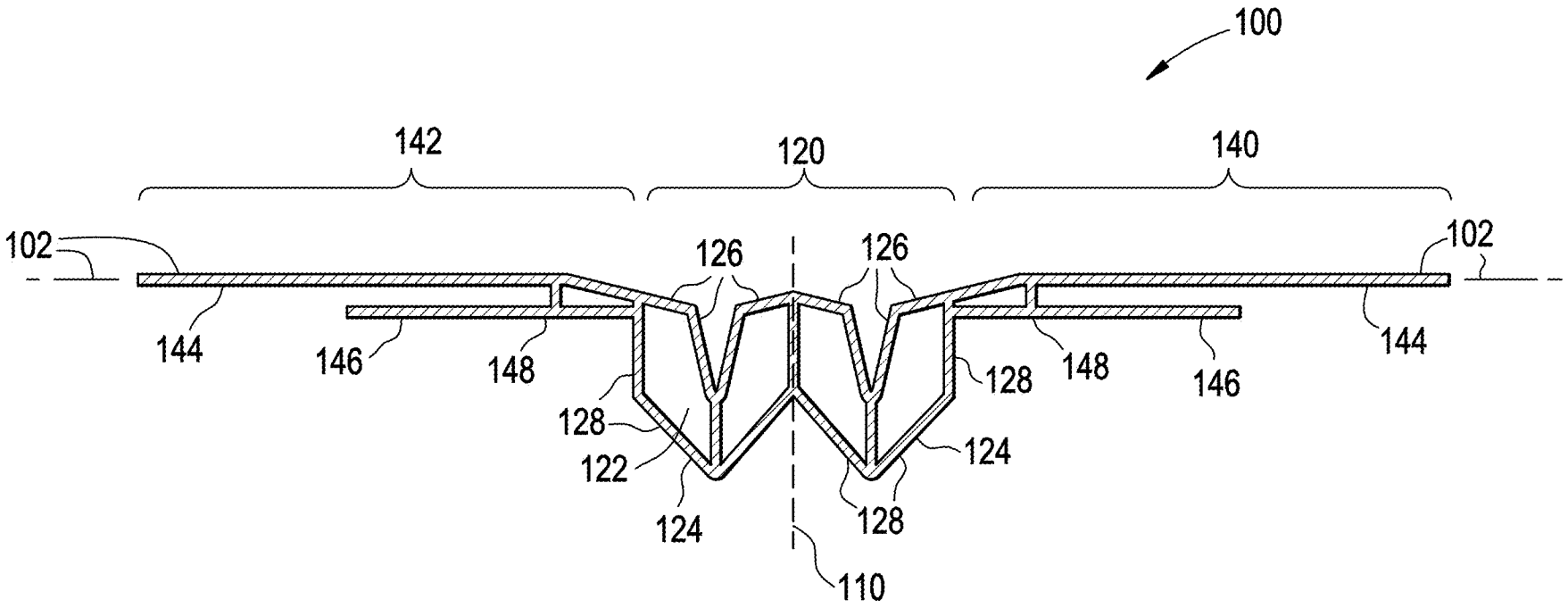
FIG. 3 is an end view of an expansion joint seal in accordance with one embodiment of the present invention before installation.
Figure 4:
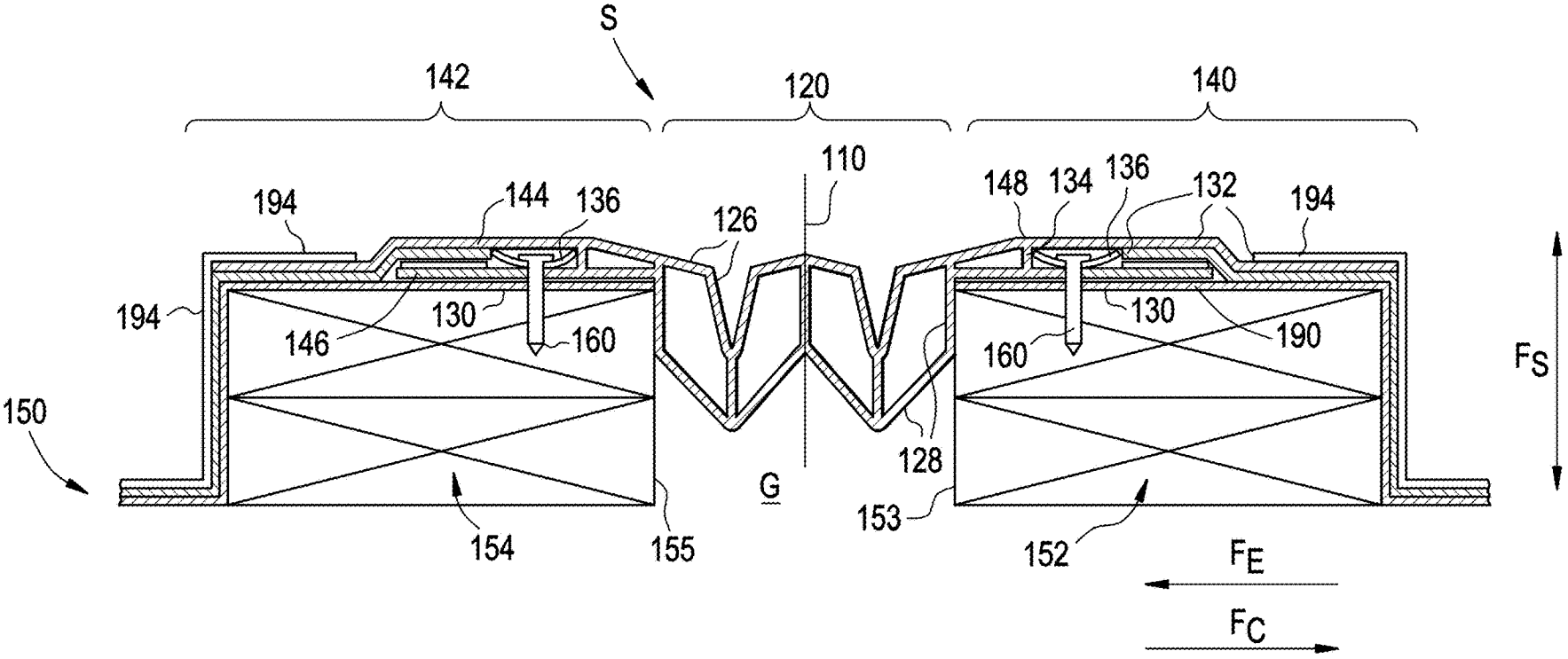
FIG. 4 is a cross-sectional view of the expansion joint seal of FIG. 3 as installed on two substantially parallel substrates.
Figure 5:
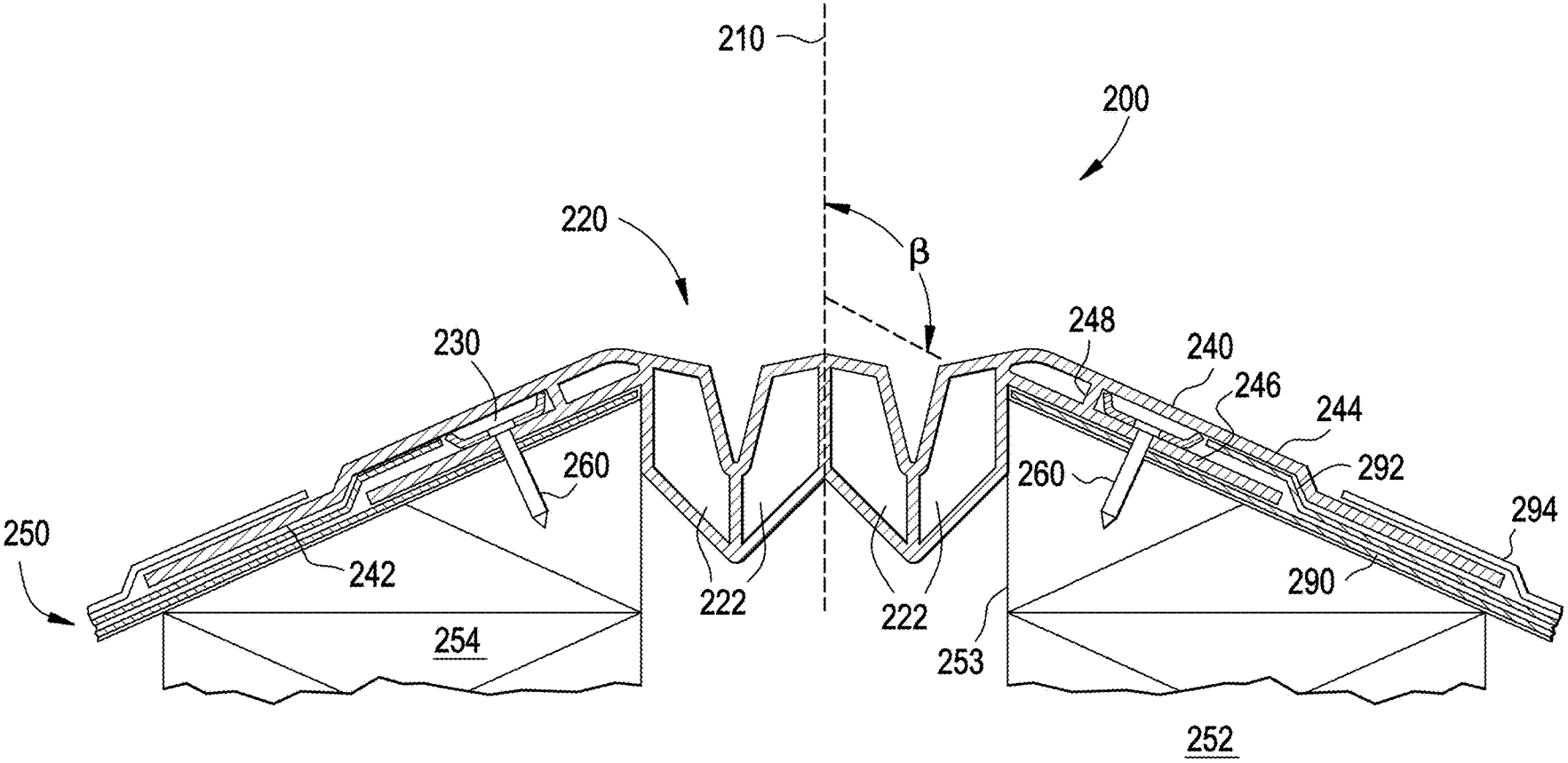
FIG. 5 is a cross-sectional view of the expansion joint seal of FIG. 3 as installed on two peaked or sloped substrates.
Figure 6:
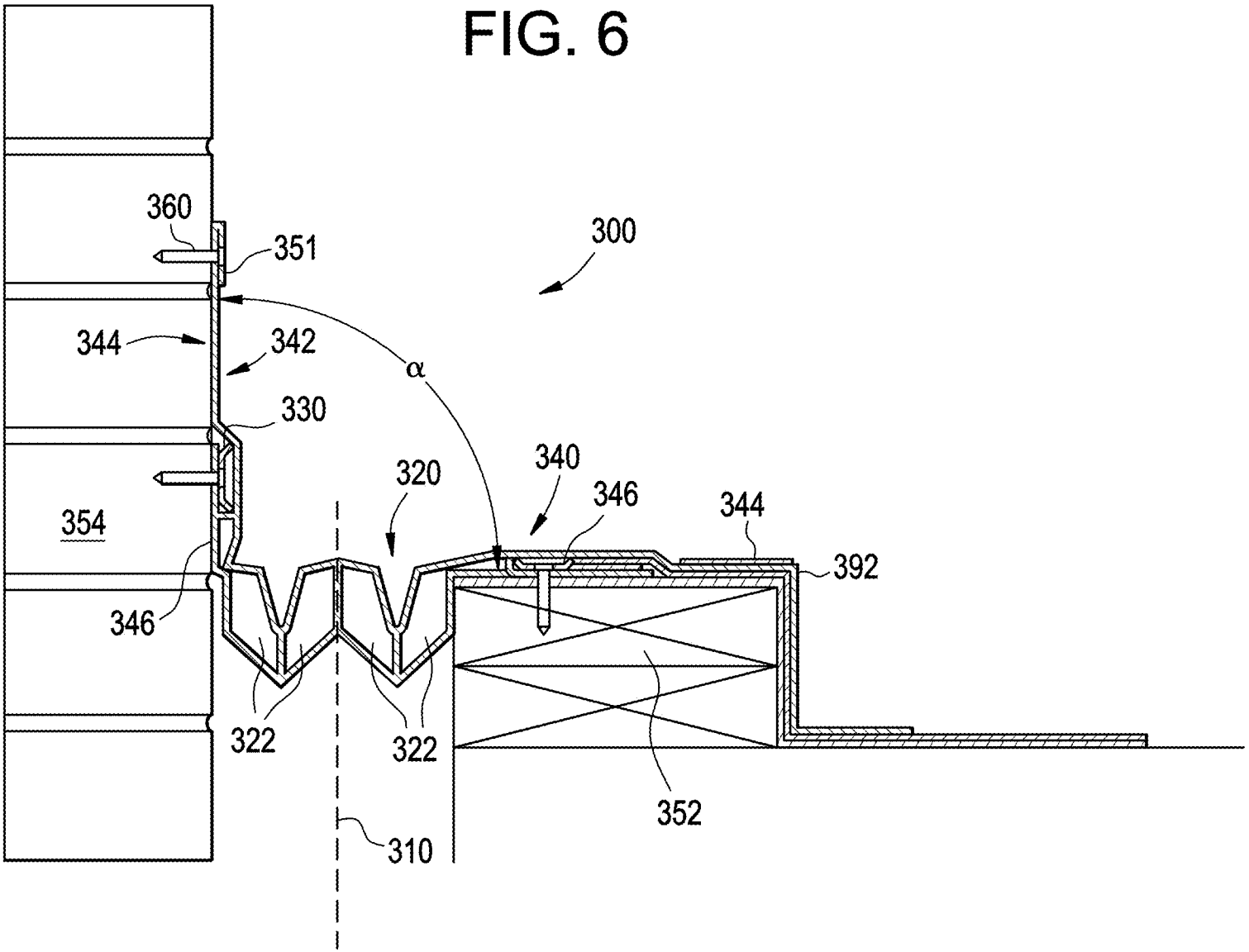
FIG. 6 is a cross-sectional view of the expansion joint seal of FIG. 3 as installed on two substantially perpendicular substrates.

Referring to FIG. 3, an expansion joint seal 100 comprises a central portion 120 disposed around a centerline 110 of the seal 100 and at least one of a first flange portion 140 and a second flange portion 142. A first continuous surface 102 of the joint seal 100 is defined by the center portion 120, the first flange portion 140, and the second flange portion 142. As described in detail below, when installed and affixed on a roof of a structure, the joint seal 100 is integrally incorporated with roofing materials on the roof such that the first surface 102 forms a seal S of a joint or gap G between structural elements of the roof (FIG. 4). As shown in FIG. 3, each of the first flange portion 140 and the second flange portion 142 extend outwardly from the centerline 110. As described above, in one embodiment the joint seal 100 is comprised of a flexible material such as, for example, a thermoplastic compound so that the first flange portion 140 and the second flange portion 142 may be affixed to a structure at differing angles and/or elevations relative to the central portion 120 and/or each other. For example, as shown in FIG. 4, the first flange portion 140 and the second flange portion 142 are coplanar in alignment at installation on structural elements 152 and 154 of a roof 150. In another installation as shown in FIG. 5, each of a first flange portion 240 and a second flange portion 242 of a joint seal 200 are installed at an angle β, shown here at approximately one hundred ten degrees (110°) relative to a centerline 210 of the joint seal 200. In another installation as shown in FIG. 6, a first flange portion 340 and a second flange portion 342 of a joint seal 300 are formed at an angle α to each other shown here, for example, at ninety degrees (90°) relative to a centerline 310. It should be understood that the angles β or α could be any degree relative to a centerline. It should further be understood that during use, the first flange portions 140, 240, 340 and the second flange portion 142, 242, 342 may move relative to the centerlines 110, 210, 310 despite the angles at initial installation. It should be appreciated that the roof expansion joint seals 200 (FIG. 5) and 300 (FIG. 6) are substantially similar to the roof expansion joint seal 100 of FIGS. 3 and 4. As such, similar numbering conventions are used to relate to similar components of these seals 100, 200 and 300.

As described below, the expansion joint seals 100, 200, 300, 400 (FIGS. 7 and 8), 500 (FIG. 9), 600 and 700 (FIG. 10) of the present invention are made from a flexible material. In one embodiment, the flexible material is a thermoplastic compound such as, for example, thermoplastic elastomers (TPEs) which could be of the families of thermoplastic vulcanizates (TPVs), such as Santoprene® (Exxon Mobil Corp., Irving, Tex.); or thermoplastic olefins (TPOs), such as OnFlex® (PolyOne Corp., Avon Lake, Ohio); or polyvinyl chloride (PVC) compounds such as FlexAlloy® (Teknor Apex Co., Pawtucket, R.I.). Thermoplastic rubber compounds are to preferable thermoset rubber compounds due to their ability to be welded to roof membrane materials of similar compounds as well as to facilitate the fabrication of heat-welded transitions in plane and direction. In one embodiment, the method of manufacture is extrusion because it permits a single cross-section design to be extended consistently throughout any desired length. In one embodiment, the expansion joint seals 100, 200, 300, 400, 500 and 600 are manufactured to fit the lengths of specific expansion joints.

Referring again to FIG. 3, in one embodiment, at least one of the first flange portion 140 and the second flange portion 142 is bifurcated into an upper flange portion 144 and a lower flange portion 146. In one embodiment, the upper flange portion 144 and the lower flange portion 146 are separated by a support wall 148 formed therebetween. As shown in FIG. 3, both the first flange portion 140 and the second flange portion 142 are bifurcated into the upper flange portion 144 and the lower flange portion 146, but it should be appreciated that this is not a requirement of the present invention. In one embodiment, the support wall 148 is substantially perpendicular to the upper flange portion 144 and the lower flange portion 146. In one embodiment, the support wall 148 extends the length of the expansion joint seal 100. In one embodiment illustrated in FIG. 8, an upper flange portion 440 of an expansion joint seal 400 (shown in partial cross section) is raised during installation so that the joint seal 400 may be affixed to a structure of interest 452 by one of a plurality of fasteners 460 affixed through a hole 441 in a lower flange portion 446 of the joint seal 400.

Figure 7:
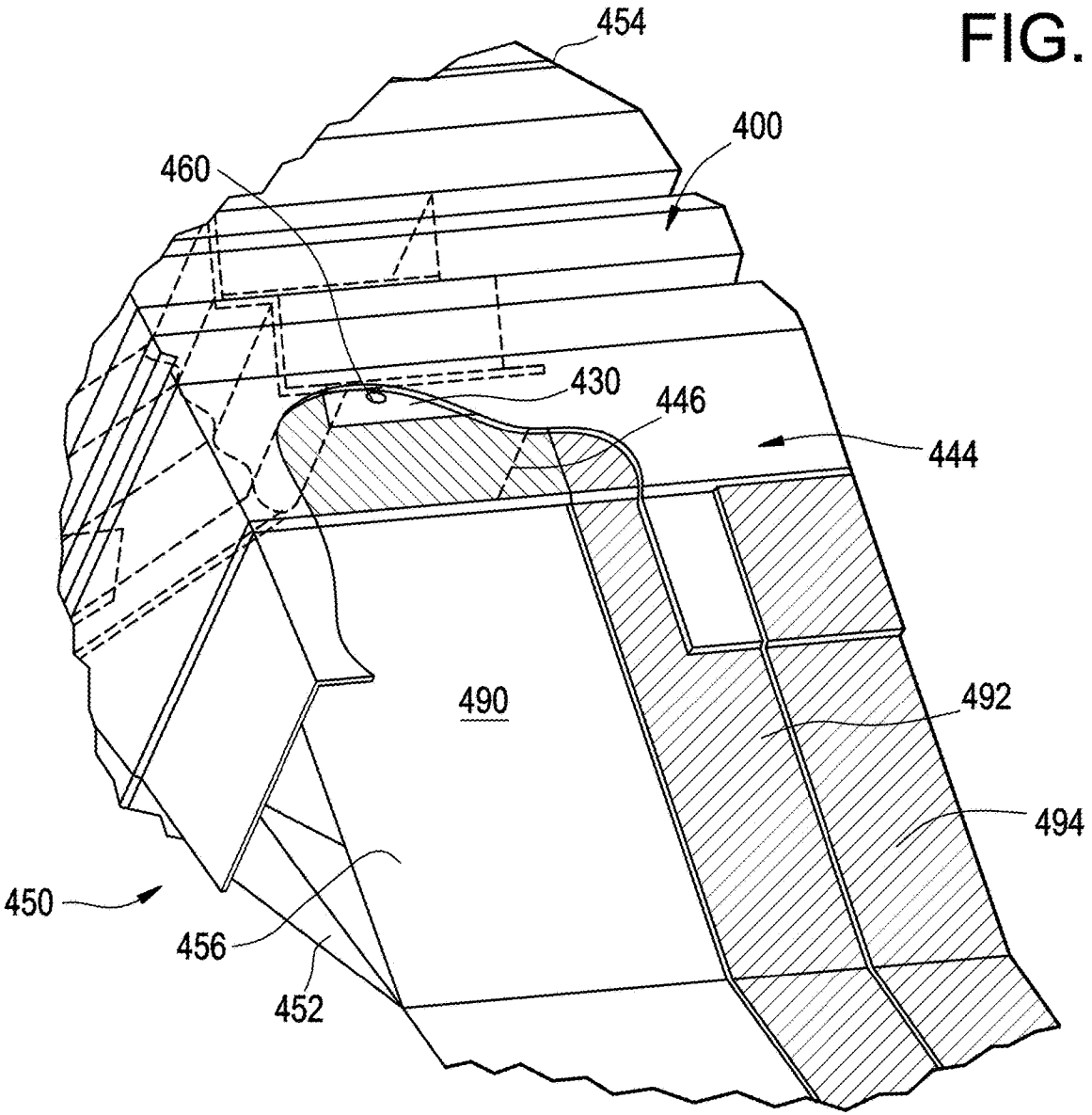
FIG. 7 is a perspective view of the expansion joint seal of FIG. 3 as installed showing an upper flange portion and a lower flange portion.
Figure 8:
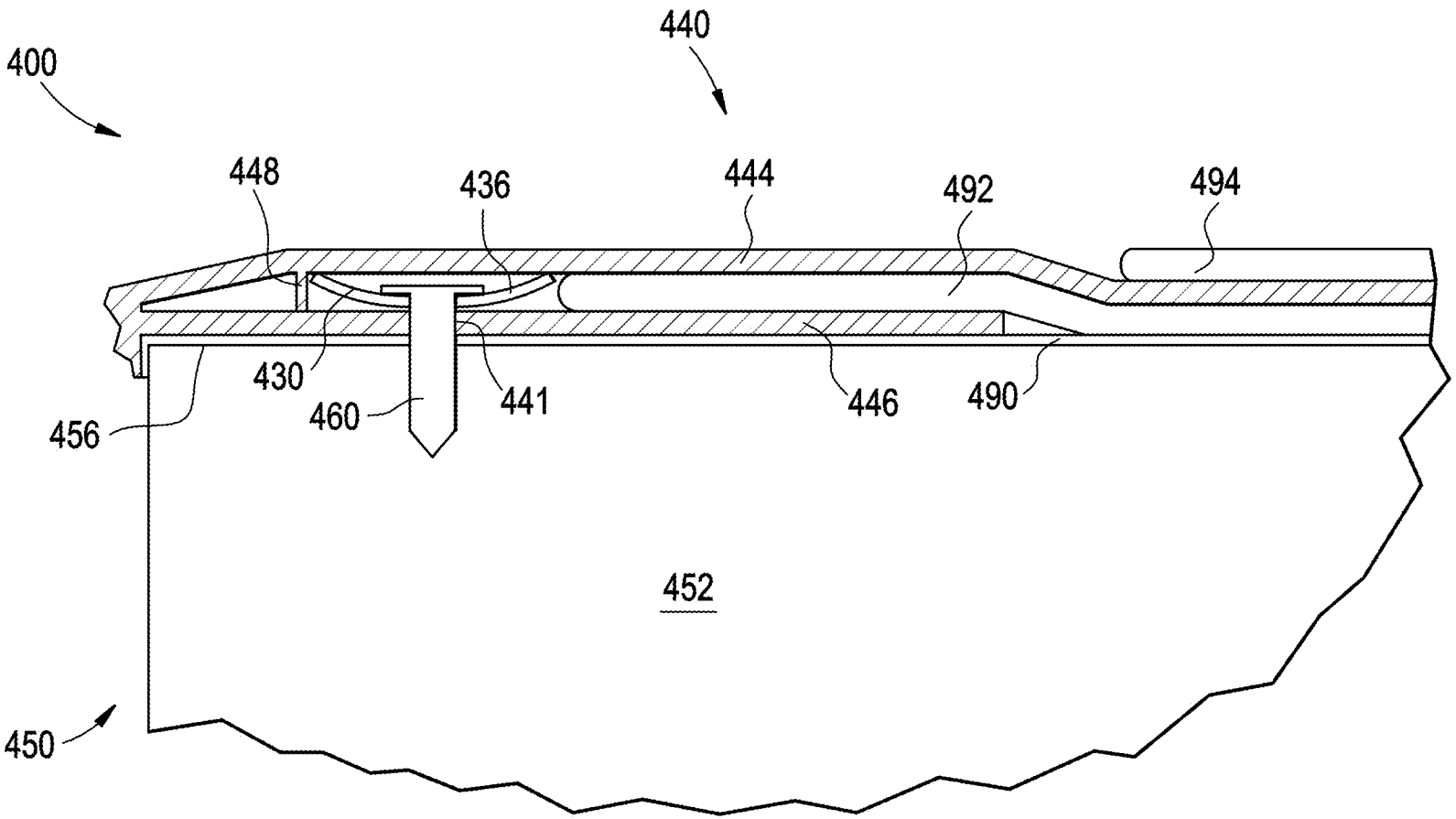
FIG. 8 is a partial cross-sectional view of a bracket (flange) with a fastener therethrough as used with the expansion joint seal of FIG. 3.

In one embodiment, as best illustrated in FIGS. 4, 5 and 8, the upper flange portion 144, 244, 444 extends further in length away from the centerline 110, 210, 410 of the joint seal 100, 200, 400 than the lower flange portion 146, 246, 446 such that the upper flange portion 144, 244, 444 cooperates with roofing materials 190, 290, 490 (e.g., in an interlaying manner) to provide a watertight seal with the roofing materials applied over the roof 150, 250, 450. The roofing materials are described in further detail below with reference to FIGS. 7 and 8. In another embodiment shown in FIG. 6, an upper flange portion 344 is secured to a structure of interest (e.g., a second substrate 354 of the structure) by a fastener 360 through a hole 351 in the upper flange portion 344.

Referring again to FIG. 3, the central portion 120 includes at least one central chamber 122. In one embodiment the central chamber 122 includes two or more chambers, e.g. four (4) chambers shown in FIG. 3. The central chamber 122 is formed by a side wall 124. In one embodiment, the central chamber 122 extends a length of the seal 100. In one embodiment, the side wall 124 of the central chamber 122 is configured to be selectively collapsible in response to forces exerted on the side wall 124. For example, in one embodiment, the side wall 124 of the central chamber 122 is configured into a generally pentagonal cross-section (e.g., five-sided cross-section). It should be understood that the shape of the central chambers 122, as defined by the side wall 124, can be of any selectively collapsible configuration that permits compression and expansion movement of the central chamber 122 in response to forces exerted on the side wall 124 while retaining, in an uninterrupted fashion, the first continuous surface 102 of the expansion joint seal 100. The number of central chambers 122 included within the central portion 120 can likewise be varied to accommodate different widths of expansion joint openings (e.g., widths of gap G (FIG. 4)). As shown in FIGS. 3 and 4, the side wall 124 includes a first outer surface 126 integrally formed within the first continuous surface 102 of the joint seal 100, and a second outer surface 128 opposite the first continuous surface 102. As forces from, for example, expansion ($F_E$) of the roof 150, and/or structural elements thereof 152 and 154, is exerted on the second outer surface 128 of the side wall 124, the central chamber 122 deforms or contracts (compresses) in response to the expansion force. Similarly, as forces from, for example, contraction ($F_C$) of the roof 150 is directed away from the second outer surface 128 of the side wall 124, the central chamber 122 deforms or expands in response to the contraction force.

As shown in FIG. 4, in one embodiment, the first flange portion 140 is affixed to a first substrate 152 of the roof 150 by one or more fasteners 160. The second flange portion 142 is affixed to a second substrate 154 by one or more of the fasteners 160. The central portion 120 is disposed within and fills a gap G in the roof 150 between the first substrate 152 and the second substrate 154, such as, for example, a structural expansion joint opening in the roof 150 of a structure. In one embodiment, when installed the outer surface 128 of the side wall 124 engages, for example, with an inner surface 153 of the first substrate 152 and an inner surface 155 of the second substrate 154. As one or both of the first substrate 152 and the second substrate 154 expands or contracts in response to, for example, one or more of thermal expansion or contraction, sway, settlement, live load deflections and/or seismic movement of the roof 150 and/or structural members thereof, the inner surfaces 153 and/or 155 exert forces toward (expansion $F_E$) or away from (contraction $F_C$) the outer surface 128, or perpendicular to (sway, settlement $F_s$) forces $F_E$ and $F_C$. The shape and position of the central chambers 122 allows the central portion 110 to expand and contract responsive to forces placed on the second outer surface 128 and the side wall 124 by the inner surfaces 153, 155 of the first substrate 152 and the second substrate 154, respectively, and maintain the seal S of the gap G. As shown in FIGS. 3-6, in one embodiment, the central portions 120, 220, 320 are comprised of four (4) central chambers 122, 222, 322 arranged in mirrored sets of two chambers opposite the center line 110, 210, 310.

Figure 9:
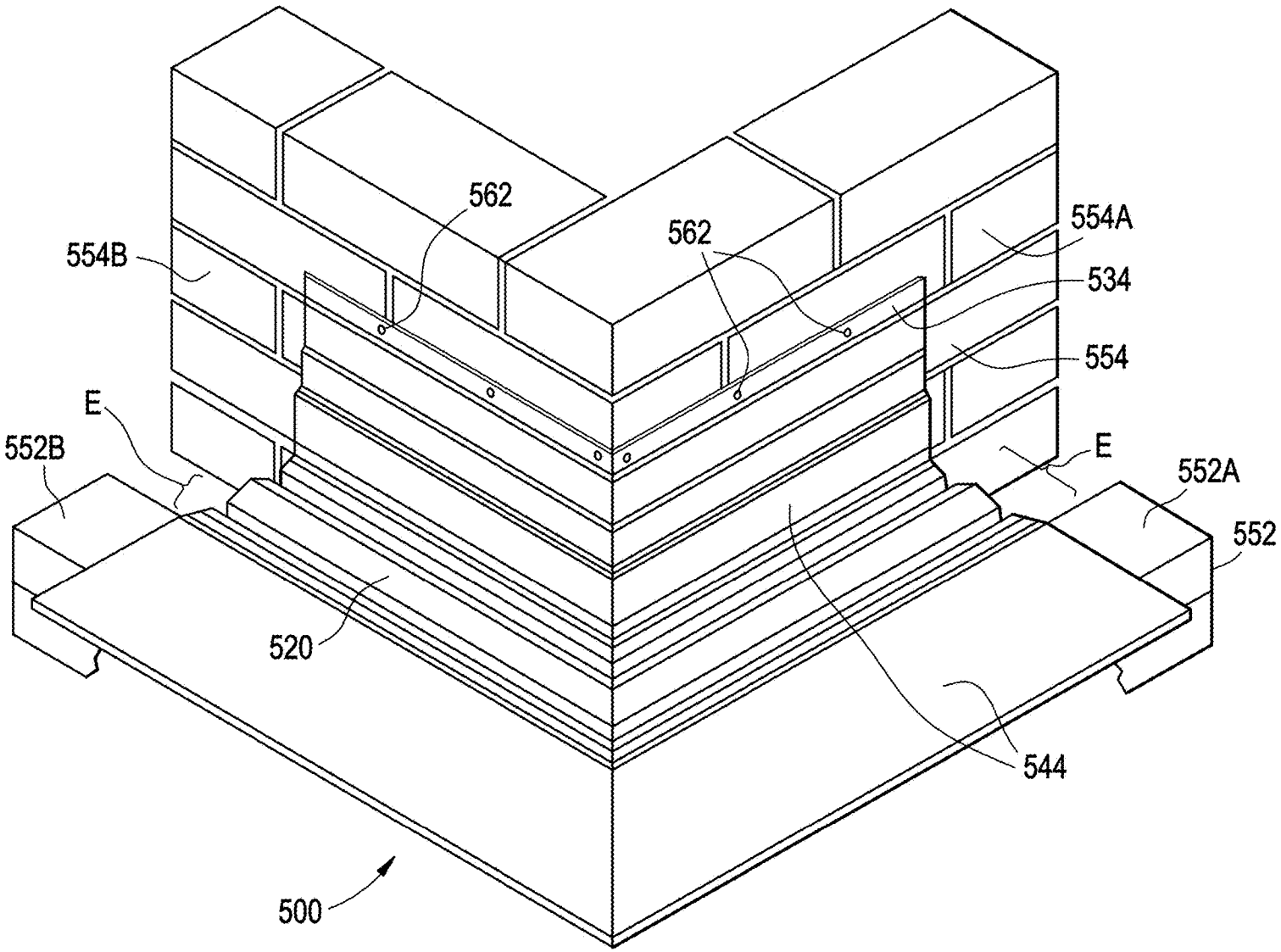
FIG. 9 is a perspective view of the expansion joint seal of FIG. 3 as installed around a corner.

As shown in FIG. 4, in one embodiment, an anchor bar 136 is disposed between the upper flange portion 144 and the lower flange portion 146 along a length of the seal 100. In one embodiment, the anchor bar 136 is comprised of sufficiently rigid material such as, for example, metal, a rigid polymer, or the like, to impart a clamping force continuously along the length of the lower flange portion 146 between the fasteners 160. Tool member 130 is also shown in FIG. 4. Referring to FIG. 8, an anchor bar 430, 436 is disposed between the upper flange portion 444 and the lower flange 446 and receives one or more fasteners 460. Roofing materials 490, 492, 494 are interlayed and cooperate with the upper flange portion 444 and the lower flange 446 to form a water tight seal of the roof 450. In one embodiment shown in FIG. 9, a roof joint seal 500 may be installed to a first substrate 552 such as, for example, a deck or flat roof portion, and a second substrate 554 such as, for example, a wall, to fill an expansion joint E therebetween. As shown in FIG. 9, the roof joint seal 500 may be configured to accommodate the expansion joint E that turns a corner. In another embodiment shown in FIG. 10, a joint seal 600 accommodates a T-intersection wherein it is attached to a first substrate 652, a second substrate 654 and a third substrate 656.

Referring to FIGS. 7 and 8, in one embodiment at least one of the first substrate 452 and the second substrate 454 are covered with a layer of the watertight roofing membrane 490 and engage for example, an upper surface 456 of the first substrate 452. In one embodiment, the lower flange portion 446 engages a first layer of the watertight roofing membrane 490. In another embodiment, the lower flange portions 446 are attached to the watertight roofing membrane 490 with a tar, adhesive of the like. In another embodiment, the lower flange portion 446 is attached to the first layer of the watertight roofing membrane 490 by welding. In another embodiment, the lower flange portion 446 is fixed to at least one of the first substrate 452 and the second substrate 454 by one of the plurality of fasteners 460 disposed through the hole 441 of the lower flange portion 446 and of the anchor bar 430. A second watertight roofing membrane 492 may then be disposed over the lower flange portions 446. In one embodiment, the second watertight roofing membrane 492 is heat-welded or otherwise adhered to the lower flange portion 446, effectively integrating the lower flange portion 446 into the roof membranes 490 and 492. In one embodiment, the upper flange portion 444 is disposed over the second water tight roofing membrane 492 and is heat-welded or otherwise adhered thereto. In this embodiment, the anchor bar 430 and the plurality of fasteners 460 are shielded from the harmful effects of moisture and environmental exposure by the upper flange portion 444. A third watertight roofing membrane 494 may then be disposed about at least a portion of the upper flange portion 444 and heat-welded or otherwise adhered thereto. This process provides a waterproof seal S over the joint by positively integrating the expansion joint seal 400 into the roofing materials (e.g., membranes 490, 492 and 494) of the roof 450.

Referring to FIG. 9, an expansion joint seal 500 is attached to a first portion 552A and a second portion 552B of a first substrate 552 forming a corner. A second substrate 554 extending vertically upward from the first substrate 552 also forms a corner having a first portion 554A and a second side portion 554B. An expansion joint between the first substrate 552 and the second substrate 554 is generally indicated at E. In one embodiment, an upper flange portion 544 is attached to the first portion 554A and the second portion 554B by an anchor bar 534 and a plurality of fasteners 562 disposed therethrough.

Figure 10:
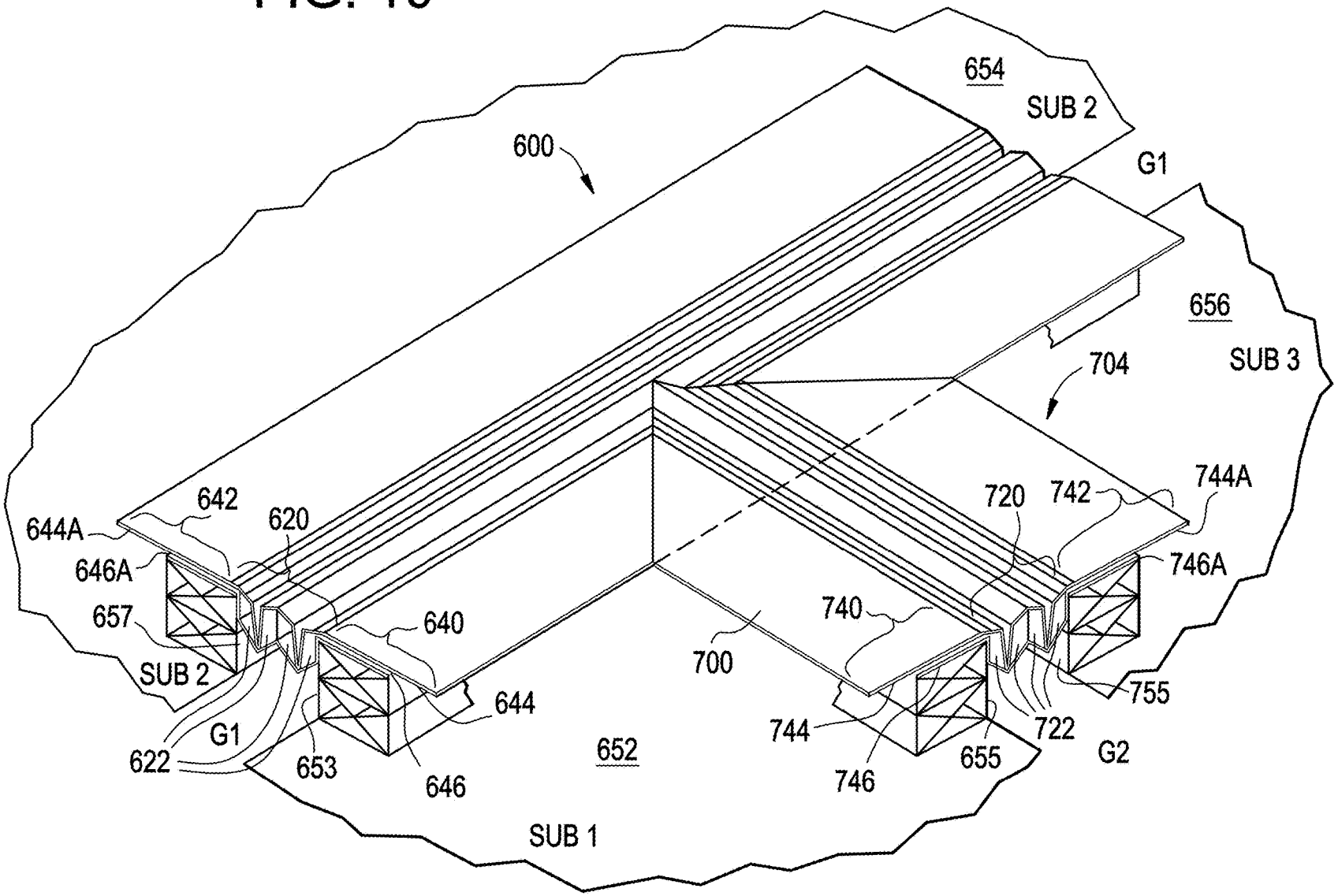
FIG. 10 is a perspective view of the expansion joint seal of FIG. 3 as installed at a T-intersection.

Referring to FIG. 10, expansion joint seals 600 and 700 are installed in a floor or deck having a T-shaped expansion joint or gaps G1 and G2. The expansion joint seal 600 is attached to a first substrate 652, a second substrate 654, and a third substrate 656. Similarly, the expansion joint seal 700 is attached to the first substrate 652 and the third substrate 656. In one embodiment, illustrated in FIG. 10, one or both of the expansion joint seals 600 and 700 are cut to taper at an intersection of the T-shaped joint or gaps G1 and G2. Alternatively, the expansion joint seal 700 is cut square to abut the expansion joint seal 600 at the intersection of T-shaped joint. As with the aforementioned expansion joint seals 100, 200, 300, 400, 500, central portions 620 and 720 of the expansion joint seals 600 and 700 are disposed in the gaps G1 and G2 between side edges 653, 655, 657 and 755 of the first substrate 652, the second substrate 654 and the third substrate 656. In one embodiment, the expansion joint seal 600 and the expansion joint seal 700 are fused together, for example, with heat sealing or adhesive. The expansion joint seal 600 has a center portion 620 with four central chambers 622 formed therein and disposed within and sealing the gap G1. Similarly, the expansion joint seal 700 has a center portion 720 with four central chambers 722 formed therein and is disposed within and filling the gap G2. Still referring to FIG. 10, in one embodiment, when any one of the first substrate 652, the second substrate 654, and/or the third substrate 656 moves as a result of thermal expansion and contraction, wind sway, settlement, live load deflection, and/or seismic movement, the central portions 620 and/or 720 respond to maintain the watertight seal over the expansion joints G1 and/or G2.

Figure 11:
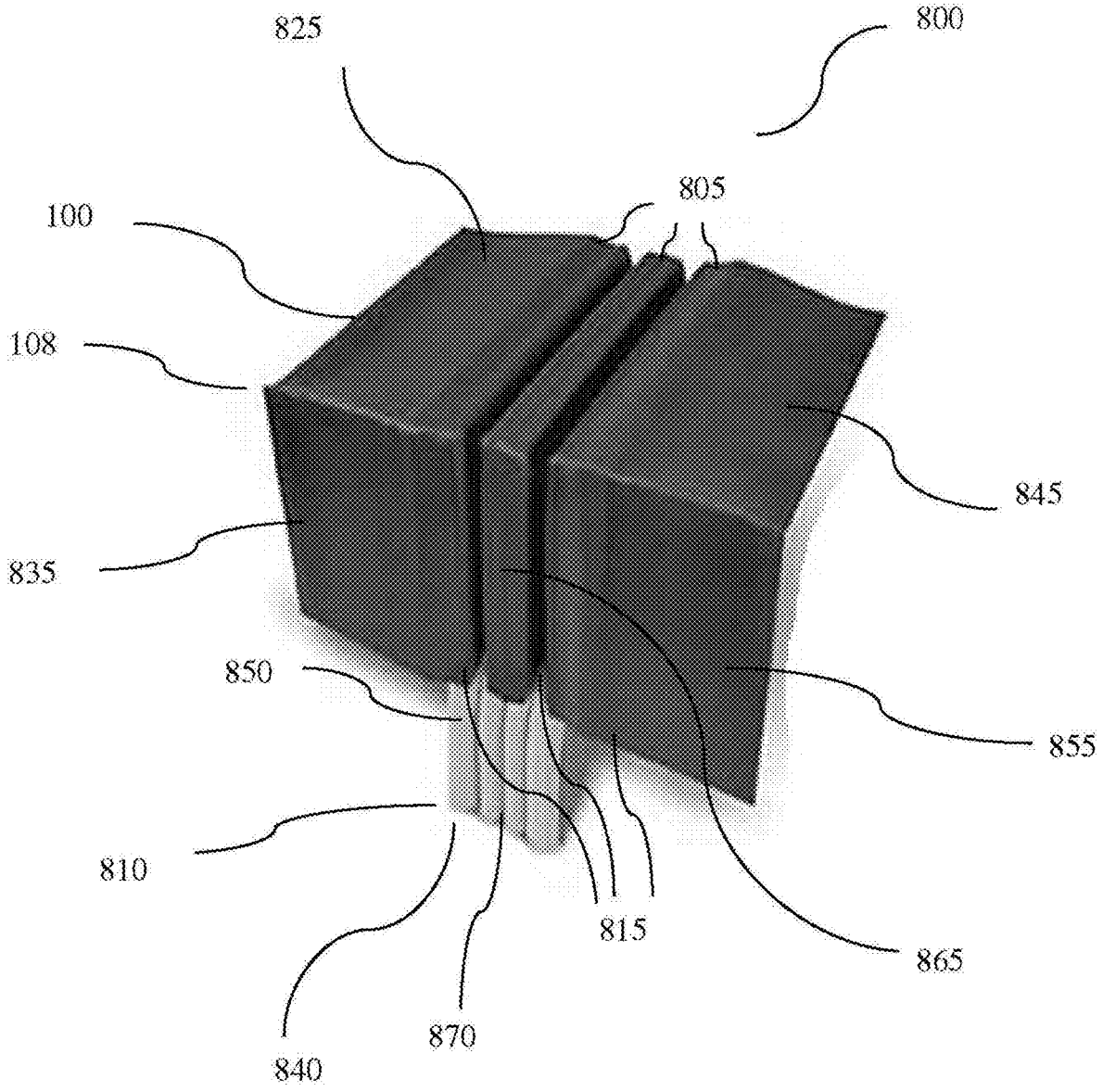
FIG. 11 is a perspective view of a watertight, integrated wall and roof expansion joint seal system comprising the expansion joint seal of FIG. 3 and a joint closure.
Figure 14:
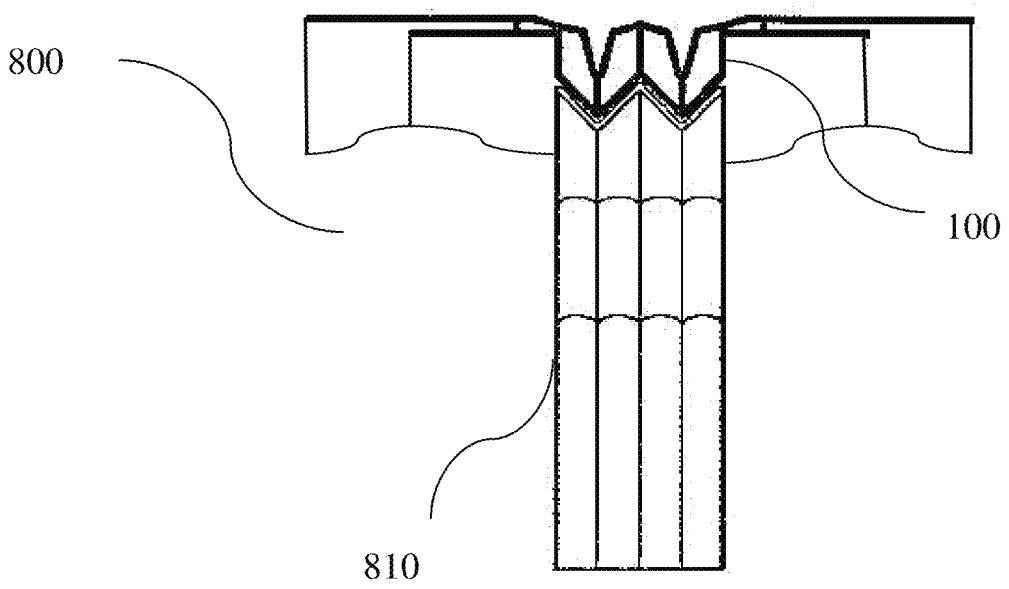
FIG. 14 is a partial, elevation view of the watertight, integrated wall and roof expansion joint seal system of FIG. 11.

As illustrated in, e.g., FIGS. 6 and 9 described above, embodiments of the present invention provide an integrated wall and roof expansion joint system. FIG. 11 illustrates another example of such a system. As shown therein, a watertight, integrated wall and roof expansion joint system 800 comprises an expansion joint seal such as, e.g., seal 100 shown in FIG. 3, and a joint closure 810. FIG. 14 schematically depicts a partial, elevation, end view of the watertight, integrated wall and roof expansion joint seal system 800 of FIG. 11.

Expansion joint seal 100 has been described above with respect to, e.g., FIG. 3. In FIGS. 11 and 14, however, expansion joint seal 100 is depicted with a bend or fold in the gland. Thus, movement at the joint can be accommodated by the folding design of the gland. The bend or fold can be configured to form any suitable angle such as about 45 degrees, 90 degrees and so forth, as further described below.

According to embodiments, the inventors have solved the problem of how to obtain a watertight transition from a roof to a wall expansion joint. Advantageously, according to embodiments and as best seen in FIG. 11, a solution lies in the expansion joint seal 100 configured to be seated in a joint-gap, a factory welded downturn transition in the gland of the seal 100 that is sealed at, e.g., about a 45 degree angle to mate with an interlocking factory fabricated transition piece (joint closure 810) made of, e.g., SEISMIC COLORSEAL. The result is an integrated wall and roof expansion joint system 800 that is watertight.

As shown in FIG. 11, watertight, integrated wall and roof expansion joint seal system 800 comprises an expansion joint seal 100 comprising a fold 108. The fold 108 comprises a first fold portion 805 shown, e.g., as a top portion, and a second fold portion 815 shown, e.g., as a side portion, wherein a first fold portion of the first flange portion 825 is attachable to a first surface of a first substrate of a structure and a second fold portion of the first flange portion 835 is attachable to a second surface of the first substrate, and a first fold portion of the second flange portion 845 is attachable to a first surface of a second substrate of the structure and a second fold portion of the second flange portion 855 is attachable to a second surface of the second substrate. The central portion 865 is disposed within and seals a gap formed between the first substrate and the second substrate of the structure.

Figure 11A:
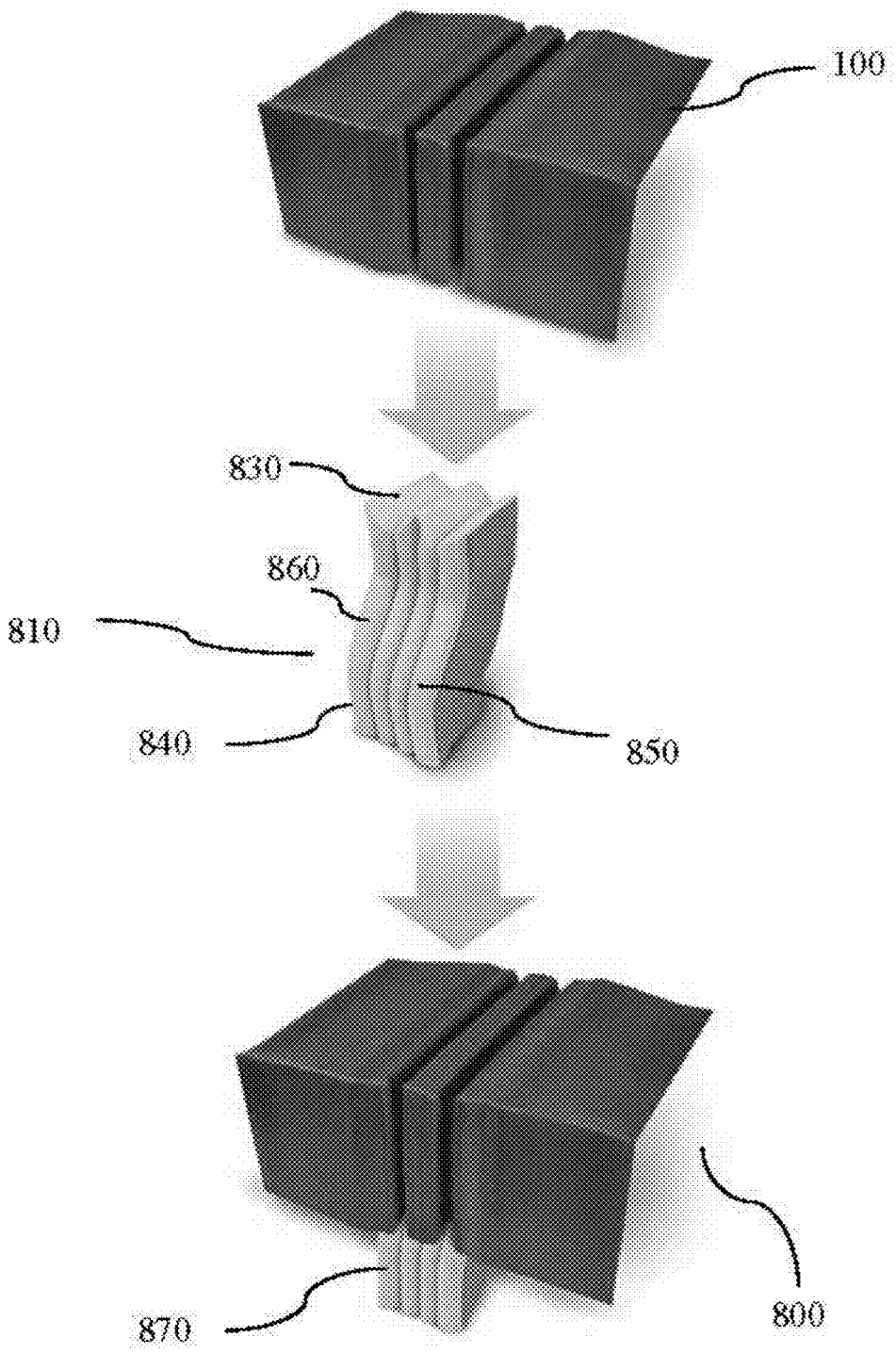
FIGS. 11A and 11B illustrate the integration of the expansion joint seal with the joint closure, according to embodiments.
Figure 11B:
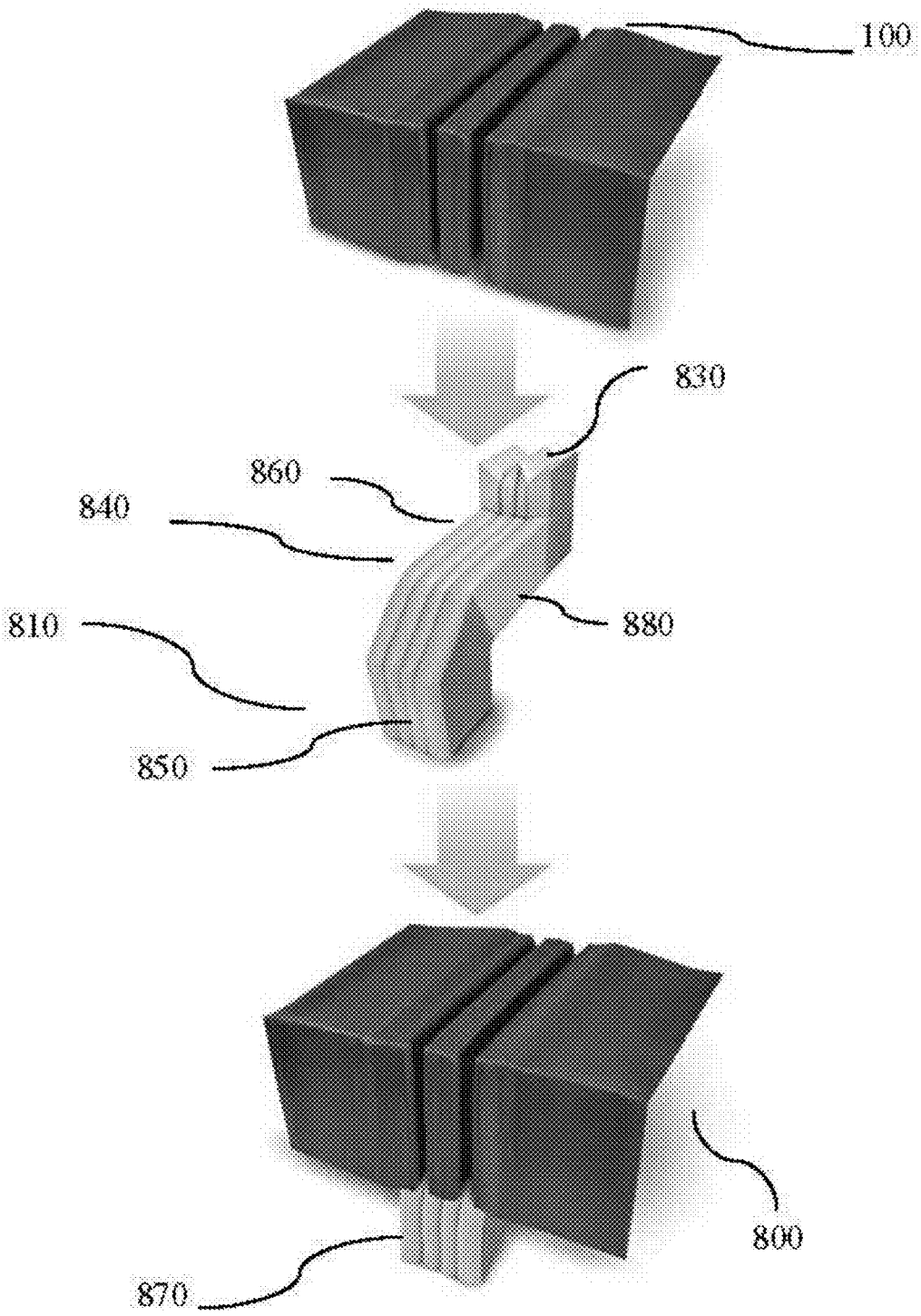
Figure 12:
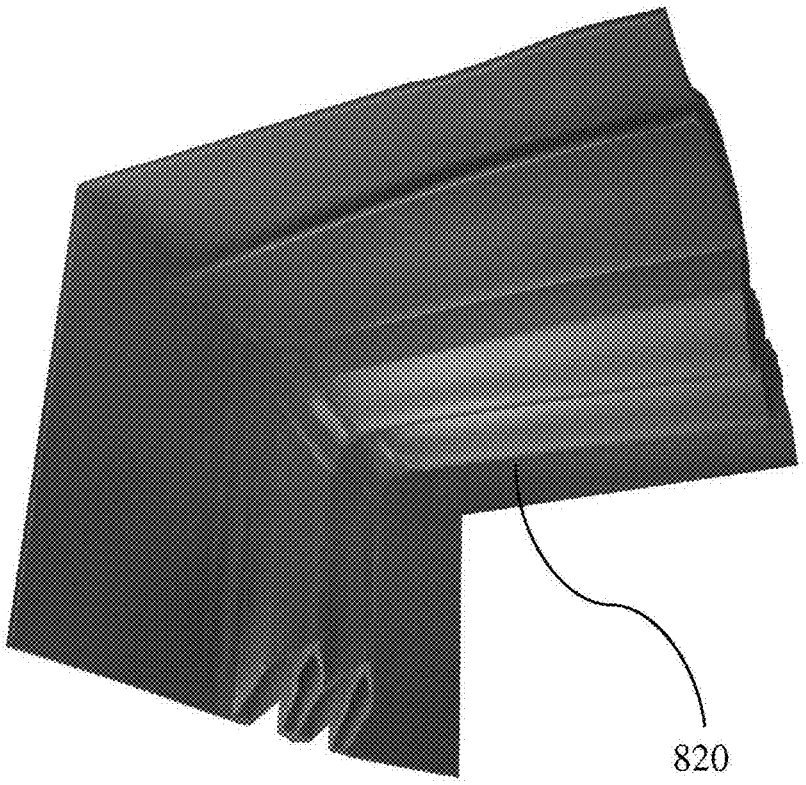
FIG. 12 is a perspective view of the underside of the expansion joint seal depicted in FIG. 11.

The expansion joint seal 100 of FIG. 11 is integrated with the joint closure 810 as shown, e.g., in FIGS. 11A and 11B to form the watertight, integrated wall and roof expansion joint seal system 800. FIG. 12 depicts the underside 820 of the expansion joint seal 100 of FIG. 11 which is integrated with an end portion 830 of the joint closure 810 as shown, e.g., in the embodiments of FIGS. 11A and 11B.

Joint closure 810 can comprise any suitable shape, size and thickness. As shown in FIGS. 11A and 11B, according to embodiments, end portion 830 of the joint closure 810 is shaped to match the underside of seal 100 of FIG. 11. Joint closure 810 comprises a core 840 and a layer of elastomer 850 on the core 840, wherein the layer of elastomer 850 is tooled to define a profile to facilitate compression by, e.g., thermal and/or seismic expansion and contraction of the system 800. The core 840 and the layer of elastomer 850 disposed thereon form an elongated section 860 (transition piece) of desired shape, size and material depending upon application and use. Examples of materials for core 840 include, but are not limited to, foam, e.g., polyurethane foam and/or polyether foam, and the core 840 can be of an open celled or dense, closed cell construction. Core 840 is not limited to a foam construction, as core 840 can be made of any suitable material. Further examples of materials for core 840 include, paper based products, cardboard, metal, plastics, thermoplastics, dense closed cell foam including polyurethane and polyether closed cell foam, cross-linked foam, neoprene foam rubber, urethane, and/or composites. Combinations of any of the foregoing materials or other suitable materials for the core 840 can also be employed.

The core 840 can be infused with a suitable material including, but not limited to, waterproofing material such as an acrylic, such as a water-based acrylic chemistry, a wax, a fire retardant material, ultraviolet (UV) stabilizers, and/or polymeric materials, and so forth. As an example, core 840 can comprise an open celled foam infused with a water-based acrylic chemistry, and/or a fire retardant material. One type of fire retardant material that may be used is a water-based aluminum tri-hydrate (also known as aluminum tri-hydroxide (ATH)). However, the present invention is not limited in this regard, as other fire retardant materials may be used. Such materials include, but are not limited to, metal oxides and other metal hydroxides, aluminum oxides, antimony oxides and hydroxides, iron compounds, such as ferrocene, molybdenum trioxide, nitrogen-based compounds, phosphorus based compounds, halogen based compounds, halogens, e.g., fluorine, chlorine, bromine, iodine, astatine, combinations of the foregoing materials, and other compounds capable of suppressing combustion and smoke formation.

As shown in FIG. 11, the core 840 can comprise individual laminations 870 of the core material, e.g., foam, one or more of which can be infused with a suitable amount of the acrylic and/or fire retardant material and/or other desired material, such as wax, and so forth. For example, individual laminations 870 can extend substantially parallel to each other and can be constructed by infusing each desired laminate with a suitable amount of, e.g., acrylic and/or fire retardant material. It should be noted that the present invention is not so limited as other manners of constructing the core 840 are also possible. For example, the core 840 is not limited to individual laminations 870 assembled to construct the laminate, as the core 840 may comprise a solid block of non-laminated foam or other suitable material of fixed size depending upon the desired joint size.

As a non-limiting example, the amount of fire retardant material infused into the core 840, such as an open celled foam, is between 3.5:1 and 4:1 by weight in a ratio with the un-infused core itself. The resultant uncompressed core whether comprising a solid block or laminates, has a density of about 130 $kg/m^3$ to about 150 $kg/m^3$, specifically 140 $kg/m^3$, according to embodiments. Further according to embodiments, the resultant uncompressed core has a density of about 50 $kg/m^3$ to about 250 $kg/m^3$, e.g., between about 100 $kg/m^3$ to about 180 $kg/m^3$.

The infused core 840, such as infused foam laminate, can be constructed in a manner which insures that substantially the same density of fire retardant is present in the product regardless of the final size of the product. For example, the starting density of the infused foam/core is approximately 140 $kg/m^3$, according to embodiments. After compression, according to embodiments, the infused foam/core density is in the range of, e.g., about 160-800 $kg/m^3$, 200-700 $kg/m^3$. After installation, the laminate can cycle between densities of approximately 750 $kg/m^3$ at the smallest size of the expansion joint to approximately 400-450 $kg/m^3$ or less at the maximum size of the joint. This density of 400-450 $kg/m^3$ is based upon experiments as a reasonable value which still affords adequate fire retardant capacity, such that the resultant composite can pass the UL 2079 test program. The present invention is not limited to cycling in the foregoing ranges, however, as the material may attain densities outside of the herein described ranges. It is further noted that UL 2079, developed by Underwriters Laboratories, is a further refinement of ASTM E-119 by adding a cycling regimen to the test. Additionally, UL 2079 stipulates that the design be tested at a maximum joint size. This test is more reflective of real world conditions, and as such, architects and engineers have begun requesting expansion joint products that meet it. Many designs which pass ASTME-119 without the cycling regime do not pass UL 2079. This may be adequate for non-moving building joints; however, most building expansion joint systems are designed to accommodate some movements as a result of thermal effects (e.g., expansion into the joint and contraction away from the joint) or as a result of seismic movement. Advantageously, embodiments of the systems disclosed herein meet and can pass UL 2079 testing. Thus, embodiments of the systems disclosed herein are capable of withstanding exposure to a temperature of at least of about 540° C. for about five minutes, capable of withstanding exposure to a temperature of about 1010° C. for about two hours, capable of withstanding exposure to a temperature of about 930° C. for about one hour, and capable of withstanding exposure to a temperature of about 1260° C. for about eight hours.

In any embodiment, for example when individual laminations 870 are used, several laminations, the number depending on the expansion joint size (e.g., the width, which depends on the distance between opposing substrates into which the expansion joint system 800 is to be installed), can be compiled and then compressed and held at such compression in a suitable fixture. The fixture, referred to as a coating fixture, is typically at a width slightly greater than that which the expansion joint will experience at the greatest possible movement thereof.

It is noted that in the fixture, the laminations 870 can be configured in any desired shape and size depending upon the desired application and end use. For example, the laminations 870 thus can be configured and factory fabricated, with use of a fixture, as a substantially straight portion of the elongated section 860 or in other configurations.

According to embodiments, in the fixture for instance, the assembled infused or un-infused core 840 is typically coated with waterproof elastomer 850 on, for example, one or more surface. The elastomer 850 may comprise, for example, at least one polysulfide, silicone, acrylic, polyurethane, polyepoxide, silyl-terminated polyether, combinations and formulations thereof, and so forth, with or with or without other elastomeric components, coatings, liquid sealant materials, and so forth. Further examples of elastomer 850 for coating, e.g., laminations 870 include PECORA 301 (available from Pecora Corporation, Harleysville, Pa.), DOW 888 (available from Dow Corning Corporation, Midland, Mich.), DOW 790 (available from Dow Corning Corporation, Midland, Mich.), DOW 795 (also available from Dow Corning Corporation), PECORA 890 (available from Pecora Corporation, Harleysville, Pa.), and so forth. A primer may be used depending on the nature of the adhesive characteristics of the elastomer 850.

During or after application of the elastomer 850 to, e.g., laminations 870, the elastomer 850 can tooled or otherwise configured to create a "bellows," "bullet," or other suitable profile. The profile can be of any suitable size and dimension. As a non-limiting example, widths less than about 1 inch have a convex single bellows surface. As a further non-limiting example, widths between about 1 inch and about 4 inches have a dual bellow surface. It is noted that the layer of elastomer 850 also can be continuous or non-continuous over the elongated section 860.

Figure 15:
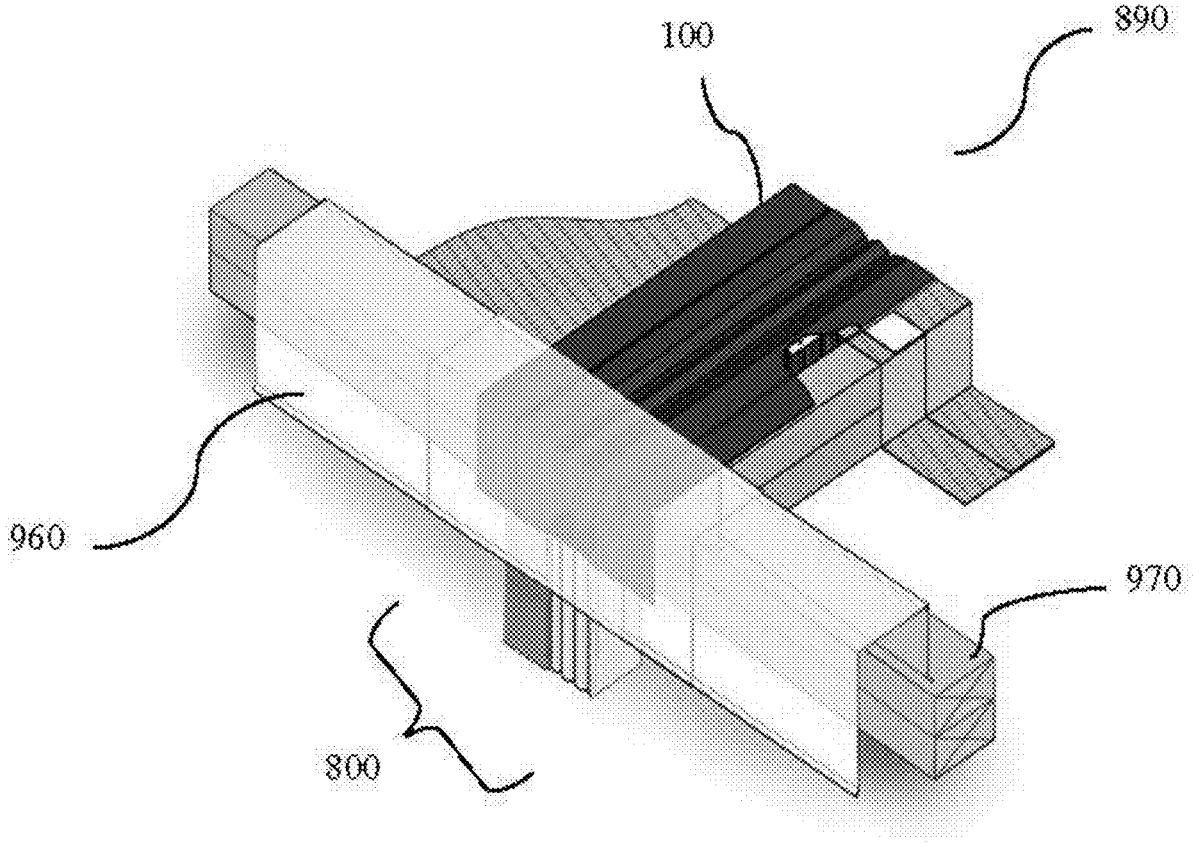
FIG. 15 is a perspective view of a construction assembly comprising the watertight, integrated wall and roof expansion joint seal system of FIG. 11 and employing the joint closure of FIG. 11A in a solid to wall roof closure application.

As noted above, the joint closure 810 comprising core 840 and elongated section 860 can be constructed in any suitable shape and size depending upon application and use such as, e.g., depending upon whether the application is a solid to wall or a cavity to wall sealing application. For example, FIG. 15 illustrates a perspective view of a construction assembly 890 comprising the watertight, integrated wall and roof expansion joint seal system 800 of FIG. 11 and employing the joint closure 810 of FIG. 11A in a solid to wall roof closure application. In this application, joint closure 810 can comprise a 45 degree miter to match a 45 degree miter of the seal 100. As further shown in FIG. 15, wood block nailer 970 can be employed with a roof parapet break-metal flashing cap 960, with an overlap in the break-metal flashing cap 960 to allow for movement.

FIG. 16 is a perspective view of the expansion joint seal system of FIG. 11 as installed in another solid to wall roof closure application (shown in FIG. 16A) and employing a joint closure 810 configured as a solid to wall transition piece (shown in FIG. 16B). As shown in FIG. 16B, the joint closure 810 can also comprise, e.g., a 45 degree miter, according to embodiments. It is noted that the upper and lower flange portions of FIG. 16 are also shown in detail in FIG. 7 and described above with respect to FIG. 7.

As a non-limiting example, in the solid to wall roof closure applications describe above with respect to, e.g., the as installed embodiment of FIG. 16A, a factory fabricated joint closure 810 can be manufactured from SEISMIC COLORSEAL wall expansion joint material sold by the subject Assignee, Emseal. This single unit piece has factory-coated silicone bellows on the top and upper back faces for integration with SEISMIC COLORSEAL in the wall and HORIZONTAL COLORSEAL, also sold by Emseal, as a secondary seal and insulator across the roof. According to embodiments, the silicone-coated top side (end portion 830) of the joint closure 810 is shaped to match the underside of the seal 100, as explained above.

FIG. 17 is a perspective view of the expansion joint seal system of FIG. 11 as installed in a cavity to wall roof closure application (shown in FIG. 17A) and employing a joint closure 810 configured as a cavity to wall transition piece (shown in FIG. 17B). As shown in FIG. 17B, the joint closure 810 also can comprise, e.g., a 45 degree miter, according to embodiments, and can be a factory-fabricated transition piece made from SEISMIC COLORSEAL. Joint closure 810 of FIG. 17B, also comprises a horizontal setback portion 880 to bridge a cavity 875 from, e.g., a structural backup wall 900 to a facade 910, as shown in FIG. 17. The sides of the "bridge" can be additionally coated with an elastomer 850, such as silicone, to seal them against moisture in the cavity 875 and to constrain the lateral expansion of the core 840 into the cavity.

Figure 13:
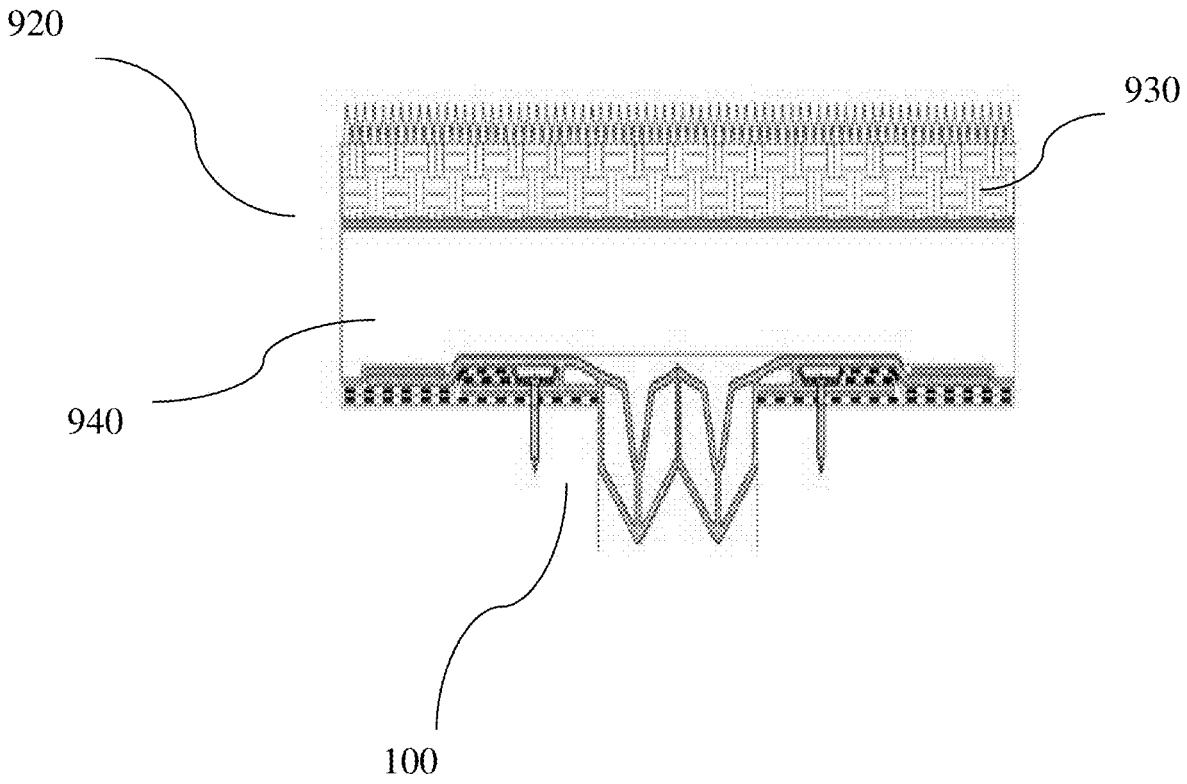
FIG. 13 is cross-section view of a garden roof assembly comprising the expansion joint seal of FIG. 3.

Thus, advantageously, according to embodiments of the invention, continuity of seal is extended to roof-to-wall configurations. Additionally, according to embodiments, the continuity of seal can also extend to, e.g., crosses, tees, upturns, downturns, and other conditions typically found in constructions projects. Moreover, embodiments of the invention are also suited for use in sealing structural slabs beneath, e.g., green, vegetative roof layers 940, as shown in FIG. 13 which illustrates a cross-section view of a garden roof assembly 920 comprising the expansion joint system 100 of FIG. 3. As the growing medium 930 is typically loose, compressible and granular, movement that occurs at the structural slab can be absorbed without detrimental effect in the green roof overburden. It is noted that growing medium 930 includes, but is not limited to soil, grass, vegetables, plants, flowers, and so forth.

Figure 18:
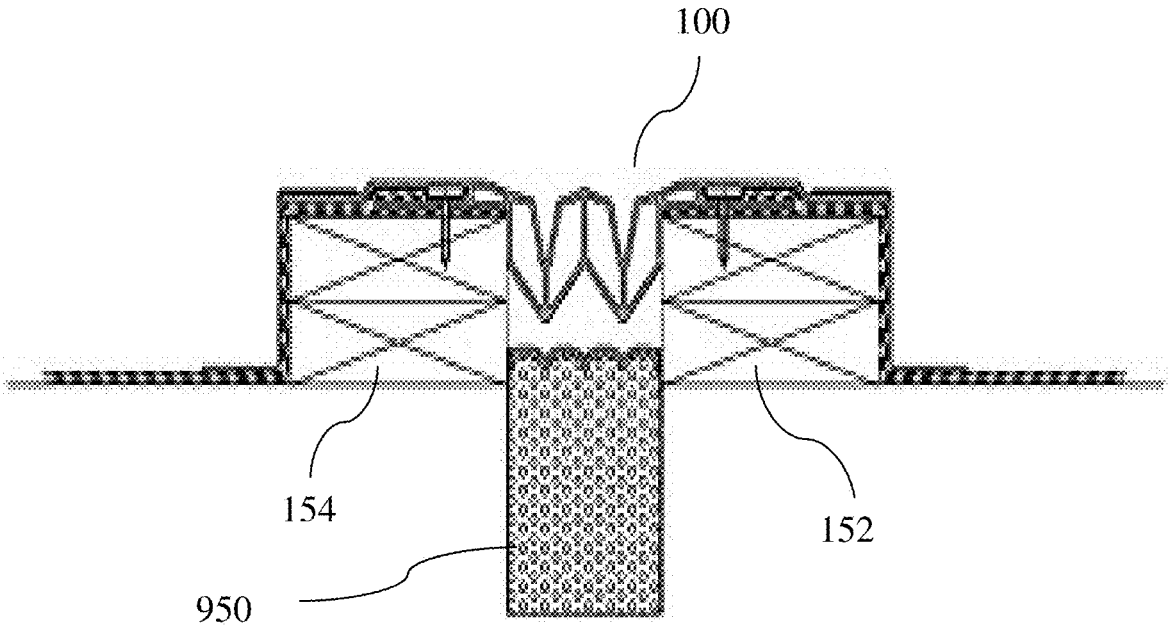
FIG. 18 illustrates the expansion joint seal depicted in FIG. 4 as installed and comprising a watertight barrier beneath the seal.

A further advantage of embodiments of the invention is in providing insulation in the joint openings beneath a roof expansion joint to maintain energy efficiency in the structure. For example, as shown in FIG. 18, depicted therein is the expansion joint seal 100 of FIG. 4 as installed on the substantially parallel substrates, and further comprising a watertight barrier beneath 950 the seal 100. The watertight barrier 950 may be any suitable materials, such as described above with respect to core 840. Typically, watertight barrier 950 comprises HORIZONTAL COLORSEAL from Emseal, as described above. An advantage of this solution is that in addition to insulating, the HORIZONTAL COLORSEAL provides an additional watertight barrier beneath the expansion joint seal 100 that can also be employed with a transition piece (joint closure 810 comprising core 840) of, e.g., SEISMIC COLORSEAL, also described above, to further ensure, e.g., continuity of seal and insulation with the wall joint.

Figure 19:
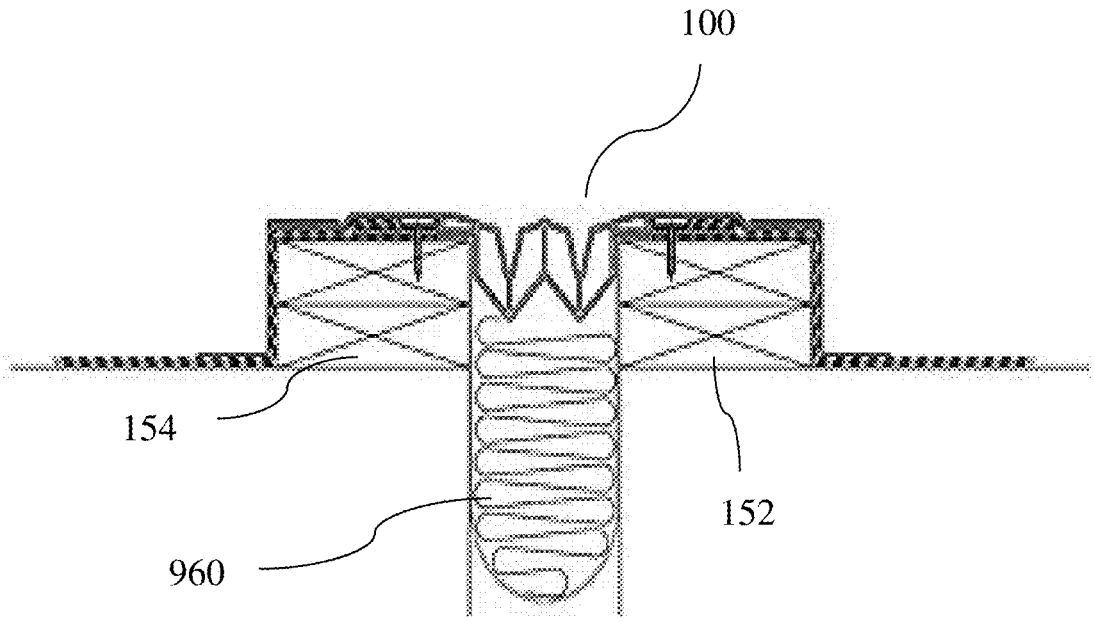
FIG. 19 illustrates the expansion joint seal depicted in FIG. 4 as installed and comprising a looped membrane of insulation beneath the seal.

FIG. 19 illustrates a further embodiment providing insulation in the joint openings beneath a roof expansion joint. For example, as shown in FIG. 19, depicted therein in the expansion joint seal 100 of FIG. 4 as installed on the substantially parallel substrates, and further comprising, e.g., batt insulation and looped membrane 960. A looped membrane 960 of suitable roofing material can be installed to support, e.g., fiberglass and/or mineral wool insulation batts, before installation of the expansion joint seal.

Thus, according to embodiments, disclosed is a fire and water resistant, integrated wall and roof expansion joint seal system. The system comprises: a) an expansion joint seal for a structure, the seal comprising: a central portion having an underside and at least one central chamber disposed around a centerline; a first flange portion extending outwardly from the centerline; and a second flange portion extending outwardly from the centerline in a direction opposite the first flange portion; and b) a joint closure comprising a core and a layer of a water resistant material disposed on the core, the joint closure further comprising an end portion configured to match and integrate with the underside of the central portion to form the fire and water resistant, integrated wall and roof expansion joint seal system. A fire retardant material is included in the core in an amount effective to pass testing mandated by UL 2079, and the core with the fire retardant material therein is configured to facilitate compression of the core when installed between the first substrate and the second substrate by repeatedly expanding and contracting to accommodate movement of the first substrate and the second substrate; and the core with the fire retardant material included therein is configured to pass the testing mandated by UL 2079; and movement of one or both of the first substrate and the second substrate causes a response in the central portion to maintain the seal. According to aspects of the invention, i) at least one of the first flange portion and the second flange portion is comprised of a flexible material such that the at least one of the first flange portion and the second flange portion may be affixed to the structure at an angle or an elevation that differs from the central portion; and/or ii) at least one of the first flange portion and the second flange portion is bifurcated into an upper flange portion and a lower flange portion, the upper flange portion extending further in length from the centerline than the lower flange portion, and the lower flange portion being substantially parallel to the upper flange portion, the thickness of each of the upper flange portion and the lower flange portion being planar and substantially the same as the thickness of the members of the sidewall; and/or iii) further including a bracket disposed between the upper flange portion and the lower flange portion to facilitate mounting of the expansion joint seal to the structure; and/or iv) wherein when installed the upper flange portion and the lower flange portion interlay with two or more layers of roofing materials; and/or v) wherein expansion of at least one of the first substrate and second substrate causes the central portion to deflect upward such that the central portion does not impinge on itself or prevent movement of one or both of the first substrate and the second substrate while maintaining the seal; and/or vi) wherein contraction of at least one of the first substrate and the second substrate causes the central portion to deflect downward such that the central portion does not impinge on itself or prevent movement of one or both of the first substrate and the second substrate while maintaining the seal; and/or vii) wherein the central portion includes a sidewall, the sidewall configured to define the at least one central chamber, the at least one central chamber being configured to be selectively collapsible in response to a force from movement of one or both of the first substrate and the second substrate; and/or viii) wherein the at least one central chamber is comprised of at least one pair of central chambers disposed about the centerline; and/or ix) wherein the at least one central chamber is comprised of an odd number of central chambers; and/or x) wherein the core comprises open celled foam comprising a plurality of individual laminations assembled to construct a laminate, one or more of the laminations being infused with the fire retardant material and an acrylic; and/or xi) wherein the core comprises an elongated section comprising a horizontal setback portion configured to bridge a gap between a structural wall and a façade; and/or xii) wherein the elongated section comprises a water resistant material coated 45 degree miter; and/or xiii) further comprising a fold comprising a first fold portion and a second fold portion, wherein the first fold portion of the first flange portion is attachable to a first surface of a first substrate of the structure and the second fold portion of the first flange portion is attachable to a second surface of the first substrate, and the first fold portion of the second flange portion is attachable to a first surface of a second substrate of the structure and the second fold portion of the second flange portion is attachable to a second surface of the second substrate, such that the central portion is disposed within and seals a gap formed between the first substrate and the second substrate of the structure; and/or xiv) wherein the core with the fire retardant material included therein has a density when compressed in a range of about 200 kg/m$^3$ to about 700 kg/m$^3$; and/or xv) wherein the core uncompressed has a density of about 130 kg/m$^3$ to about 150 kg/m$^3$; and/or xvi) wherein the core with the fire retardant material included therein has a density when compressed in a range of about 160 kg/m$^3$ to about 800 kg/m$^3$; and/or xvii) wherein the core uncompressed has a density of about 50 kg/m$^3$ to about 250 kg/m$^3$; and/or xviii) wherein the system is configured to maintain fire resistance upon exposure to a temperature of about 540° C. at about five minutes; and/or xix) wherein the system is configured to maintain fire resistance upon exposure to a temperature of about 930° C. at about one hour; and/or xx) wherein the system is configured to maintain fire resistance upon exposure to a temperature of about 1010° C. at about two hours.

While the invention has been described with reference to various exemplary embodiments, it will be understood by those skilled in the art that various changes may be made and equivalents may be substituted for elements thereof without departing from the scope of the invention. Moreover, the embodiments disclosed herein can be employed in any combination with each other. In addition, many modifications may be made to adapt a particular situation or matter to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A fire and water resistant, integrated wall and roof expansion joint seal system comprising:

a) an expansion joint seal configured to attach to a structure having a first substrate and a second substrate, the first substrate and second substrate each having opposing surfaces defining a gap between the first substrate and the second substrate of the structure, the expansion joint seal comprising:

a central portion having an underside and at least one central chamber disposed around a centerline, the at least one central chamber is formed by a side wall, the side wall having an outer surface, wherein the at least one chamber is selectively collapsible by deforming and at least one of contracting and expanding in response to forces exerted on the outer surface of the side wall;

a first flange portion extending outwardly from the centerline, wherein the first flange portion is attachable to the first substrate; and a second flange portion extending outwardly from the centerline in a direction opposite the first flange portion, wherein the second flange portion is attachable to the second substrate;

wherein the first flange portion is configured to attach to the first substrate and the second flange portion is configured to attach to the second substrate to dispose the central portion at least partially in the gap; and b) a joint closure configured to be compressed in the gap and to at least one of expanding and contract against the opposing surfaces of the first substrate and the second substrate, the joint closure comprising a compressible core, the compressible core having an end portion compressed in the gap between the opposing surfaces of the first substrate and the second substrate and configured to match and interlock with the expansion joint seal by being complementary to at least a portion of the outer surface of the side wall of the at least one chamber defining the underside of the central portion of the expansion joint seal to form the fire and water resistant, integrated wall and roof expansion joint seal system;

a fire retardant material is infused in the core to have a compressed density effective to pass testing as provided by UL 2079, and the core with the fire retardant material infused therein is configured to facilitate compression of the core when compressed by the opposing surfaces of the first substrate and the second substrate by repeatedly expanding and contracting together with the at least one chamber of the expansion joint seal to accommodate movement of the first substrate and the second substrate; and the core with the fire retardant material infused therein is configured to maintain fire resistance upon exposure to a temperature of about 540° C. at about five minutes and is configured to pass the testing as provided by UL 2079;

wherein movement of one or both of the first substrate and the second substrate causes a response in the central portion of the expansion joint seal and in the joint closure to maintain a seal of the gap.

2. The fire and water resistant, integrated wall and roof expansion joint seal system of claim 1, wherein at least one of the first flange portion and the second flange portion is comprised of a flexible material such that the at least one of the first flange portion and the second flange portion may be affixed to the structure at an angle or an elevation that differs from the central portion.

3. The fire and water resistant, integrated wall and roof expansion joint seal system of claim 1, wherein at least one of the first flange portion and the second flange portion is bifurcated into an upper flange portion and a lower flange portion, the upper flange portion extending further in length from the centerline than the lower flange portion, and the lower flange portion being substantially parallel to the upper flange portion, the thickness of each of the upper flange portion and the lower flange portion being planar and substantially the same as the thickness of the members of the sidewall.

4. The fire and water resistant integrated wall and roof expansion joint seal system of claim 3, further including a bracket disposed between the upper flange portion and the lower flange portion to facilitate mounting of the expansion joint seal to the structure.

5. The fire and water resistant, integrated wall and roof expansion joint seal system of claim 3, wherein when attached to the structure the upper flange portion and the lower flange portion interlay with two or more layers of roofing materials disposed on the structure.

6. The fire and water resistant, integrated wall and roof expansion joint seal system of claim 1, wherein expansion of at least one of the first substrate and second substrate causes the central portion to deflect upward such that the central portion does not impinge on itself or prevent movement of one or both of the first substrate and the second substrate while maintaining the seal.

7. The fire and water resistant, integrated wall and roof expansion joint seal system of claim 1 wherein contraction of at least one of the first substrate and the second substrate causes the central portion to deflect downward such that the central portion does not impinge on itself or prevent movement of one or both of the first substrate and the second substrate while maintaining the seal.

8. The fire and water resistant, integrated wall and roof expansion joint seal system of claim 1, wherein the at least one central chamber is comprised of at least one pair of central chambers disposed about the centerline.

9. The fire and water resistant, integrated wall and roof expansion joint seal system of claim 1 wherein the at least one central chamber is comprised of an odd number of central chambers.

10. The fire and water resistant, integrated wall and roof expansion joint seal system of claim 1, wherein the core comprises open celled foam comprising a plurality of individual laminations assembled to construct a laminate, one or more of the laminations being infused with the fire retardant material and an acrylic.

11. The fire and water resistant, integrated wall and roof expansion joint seal system of claim 1, wherein the core comprises an elongated section comprising a horizontal setback portion configured to bridge a cavity between a structural wall and a façade of the structure.

12. The fire and water resistant, integrated wall and roof expansion joint seal system of claim 11, wherein the elongated section comprises water resistant material coated 45 degree miter.

13. The fire and water resistant, integrated wall and roof expansion joint seal system of claim 3, further comprising a fold comprising a first fold portion and a second fold portion, wherein the first fold portion of the first flange portion is attachable to a first surface of the first substrate of the structure and the second fold portion of the first flange portion is attachable to a second surface of the first substrate, and the first fold portion of the second flange portion is attachable to a first surface of the second substrate of the structure and the second fold portion of the second flange portion is attachable to a second surface of the second substrate, such that the central portion is disposed at least partially within and together with the joint closure seals the gap formed between the first substrate and the second substrate of the structure.

14. The fire and water resistant, integrated wall and roof expansion joint seal system of claim 1, wherein the core with the fire retardant material infused therein has a compressed density in a range of about 200 kg/m$^3$ to about 700 kg/m$^3$ when compressed in the gap between the first substrate and the second substrate.

15. The fire and water resistant, integrated wall and roof expansion joint seal system of claim 1, wherein the core with the fire retardant material infused therein uncompressed has a density of about 130 kg/m$^3$ to about 150 kg/m$^3$.

16. The fire and water resistant, integrated wall and roof expansion joint seal system of claim 1, wherein the core with the fire retardant material infused therein uncompressed has a density of about 50 kg/m$^3$ to about 250 kg/m$^3$.

17. The fire and water resistant, integrated wall and roof expansion joint seal system of claim 1, wherein the core with the fire retardant material infused therein is configured to maintain fire resistance upon exposure to a temperature of about 930° C. at about one hour when compressed in the gap between the first substrate and the second substrate.

18. The fire and water resistant, integrated wall and roof expansion joint seal system of claim 1, wherein the core with the fire retardant material infused therein is configured to maintain fire resistance upon exposure to a temperature of about 1010° C. at about two hours when compressed in the gap between the first substrate and the second substrate.

19. The fire and water resistant, integrated wall and roof expansion joint seal system of claim 1, wherein the core with the fire retardant material infused therein has a compressed density in a range of about 160 kg/m$^3$ to about 800 kg/m$^3$ when compressed in the gap between the first substrate and the second substrate.

20. The fire and water resistant, integrated wall and roof expansion joint seal system of claim 1, further comprising a layer of a water resistant material disposed on the core.

21. The fire and water resistant, integrated wall and roof expansion joint seal system of claim 20, wherein the layer of the water resistant material is selected from the group consisting of a polysulfide, silicone, acrylic, polyurethane, poly-epoxide, silyl-terminated polyether, and combinations of one or more of the foregoing.

22. The fire and water resistant, integrated wall and roof expansion joint seal system of claim 1, wherein the core is selected from the group consisting of foam including at least one of polyurethane foam and polyether foam in at least one an open celled and dense closed cell construction, a paper based product, cardboard, metal, plastic, thermoplastic, dense closed cell foam including polyether closed cell foam, cross-linked foam, neoprene foam rubber, urethane, composites, and combinations thereof.

23. The fire and water resistant, integrated wall and roof expansion joint seal system of claim 1, wherein the core is selected from the group consisting of a plurality of laminations and a solid block of non-laminated material.

24. The fire and water resistant, integrated wall and roof expansion joint seal system of claim 1, further including at least one of an acrylic, a water-based acrylic chemistry, a wax, ultraviolet stabilizers, and polymeric materials, disposed in the core.

25. The fire and water resistant, integrated wall and roof expansion joint seal system of claim 1, wherein the fire retardant infused in the core is selected from the group consisting of water-based aluminum tri-hydrate, metal oxides, metal hydroxides, aluminum oxides, antimony oxides and hydroxides, iron compounds, ferrocene, molybdenum trioxide, nitrogen-based compounds, phosphorus based compounds, halogen based compounds, halogens, fluorine, chlorine, bromine, iodine, astatine, and combinations of the foregoing materials.

26. The fire and water resistant, integrated wall and roof expansion joint seal system of claim 11, wherein the gap between the first substrate and the second substrate is disposed within a roof of the structure, and the fire and water resistant, integrated wall and roof expansion joint seal system provides a continuity of the seal of the gap and the cavity between the structural wall and the façade of the structure.

27. A fire and water resistant, integrated wall and roof expansion joint seal system comprising:

a) an expansion joint seal configured to attach to a structure having a first substrate and a second substrate, the first substrate and second substrate each having opposing surfaces defining a gap between the first substrate and the second substrate of the structure, the expansion joint seal comprising:

a central portion having an underside and at least one central chamber disposed around a centerline, the at least one central chamber includes a side wall, the side wall having an outer surface, wherein the at least one chamber is selectively collapsible by deforming and at least one of contracting and expanding in response to forces exerted on the outer surface of the side wall;

a first flange portion extending outwardly from the centerline, wherein the first flange portion is attachable to the first substrate; and a second flange portion extending outwardly from the centerline in a direction opposite the first flange portion, wherein the second flange portion is attachable to the second substrate;

wherein the first flange portion is configured to attach to the first substrate and the second flange portion is configured to attach to the second substrate to dispose the central portion at least partially in the gap; and b) a joint closure configured to be compressed in the gap and to at least one of expand and contract against the opposing surfaces of the first substrate and the second substrate, the joint closure comprising a core, the core having an end portion compressed in the gap between the opposing surfaces of the first substrate and the second substrate and configured to match and interlock with the expansion joint seal by being complementary to at least a portion of the outer surface of the side wall defining the underside of the central portion of the expansion joint seal; and a fire retardant material is disposed in the core, the core with the fire retardant material therein having a compressed density effective to pass testing as provided by UL 2079, and the core with the fire retardant material therein is configured to facilitate compression of the core when compressed by the opposing surfaces of the first substrate and the second substrate by repeatedly expanding and contracting together with the at least one chamber of the expansion joint seal to accommodate movement of the first substrate and the second substrate;

wherein movement of one or both of the first substrate and the second substrate causes a response in the central portion of the expansion joint seal and in the joint closure to maintain a seal of the gap.

28. The fire and water resistant, integrated wall and roof expansion joint seal system of claim 27, wherein the core with the fire retardant material therein has a compressed density in a range of about 160 kg/m$^3$ to about 800 kg/m$^3$ when compressed in the gap between the first substrate and the second substrate.

29. The fire and water resistant, integrated wall and roof expansion joint seal system of claim 27, wherein the core with the fire retardant material therein is configured to maintain fire resistance upon exposure to a temperature of about 930° C. at about one hour and is configured to pass the testing as provided by UL 2079.

30. The fire and water resistant, integrated wall and roof expansion joint seal system of claim 27, further comprising a layer of a water resistant material disposed on the core.

31. The fire and water resistant, integrated wall and roof expansion joint seal system of claim 27, wherein the core further comprises an elongated section comprising a horizontal setback portion configured to bridge a cavity between a structural wall and a façade of the structure.

32. The fire and water resistant, integrated wall and roof expansion joint seal system of claim 27, wherein the side wall of the at least one central chamber of the expansion joint seal is configured to have a multi-sided cross-section.

* * * * *